US012808221B2

(12) United States Patent
Lentz et al.

(10) Patent No.: US 12,808,221 B2
(45) Date of Patent: Nov. 24, 2026

(54) TELESCOPING MAST ASSEMBLY WITH STOP DEVICE

(71) Applicant: Generac Power Systems, Inc., Waukesha, WI (US)

(72) Inventors: Nicholas Charles Lentz, Waterford, WI (US); Michael Joseph Finley, Waunakee, WI (US)

(73) Assignee: Generac Power Systems, Inc., Waukesha, WI (US)

( * ) Notice: Subject to any disclaimer, the term of this patent is extended or adjusted under 35 U.S.C. 154(b) by 63 days.

(21) Appl. No.: 18/654,528

(22) Filed: May 3, 2024

(65) Prior Publication Data

US 2024/0368912 A1 Nov. 7, 2024

Related U.S. Application Data

(60) Provisional application No. 63/464,114, filed on May 4, 2023.

(51) Int. Cl.
*E04H 12/18* (2006.01)

(52) U.S. Cl.
CPC ..... *E04H 12/182* (2013.01)

(58) Field of Classification Search
CPC ..... F16B 7/105; E04H 12/182; F21V 21/22; H01Q 1/103; F16M 11/28
See application file for complete search history.

(56) References Cited

U.S. PATENT DOCUMENTS

| | | | | |
|---|---|---|---|---|
| 4,600,348 | A * | 7/1986 | Pettit | E04F 21/1822 254/3 C |
| 4,842,311 | A | 6/1989 | White | |
| 6,546,677 | B1 * | 4/2003 | Featherstone | H01Q 1/325 362/384 |
| 9,598,875 | B1 | 3/2017 | Bateman et al. | |
| 10,183,847 | B2 * | 1/2019 | Holly | B66C 23/70 |
| 10,866,494 | B1 * | 12/2020 | Bergmann | G03B 17/561 |
| 11,807,030 | B1 * | 11/2023 | Hayes | F16M 11/242 |
| 11,992,002 | B1 * | 5/2024 | Reynoso | F16M 11/28 |

(Continued)

FOREIGN PATENT DOCUMENTS

| | | |
|---|---|---|
| CA | 607285 A | 10/1960 |
| EP | 3392548 A1 | 10/2018 |

(Continued)

OTHER PUBLICATIONS

PCT International Searching Authority, International Search Report and Written Opinion for Application No. PCT/US2024/027835 mailed Oct. 1, 2024, 17 pages.

*Primary Examiner* — Gisele D Ford
(74) *Attorney, Agent, or Firm* — Merchant & Gould P.C.

(57) ABSTRACT

A telescoping mast assembly with stop device. The telescoping mast assembly includes multiple pillars, one or more of which is able to be moved between an extended position and a retracted position. The stop device is mountable to the telescoping mast assembly and functions to prevent the rapid movement of the telescoping mast assembly from the extended position to the retracted position. The stop device includes a pin coupled to a pulley and is movable between an engaged position, in which the stop device restricts the movement a pillar, and a disengaged position in which the stop device does not restrict the movement of the pillar.

20 Claims, 21 Drawing Sheets

(56) References Cited

U.S. PATENT DOCUMENTS

| | | | | |
|---|---|---|---|---|
| 2007/0014116 | A1* | 1/2007 | Yoshimori | F21V 21/36 362/418 |
| 2008/0002967 | A1* | 1/2008 | Chapman | G03B 17/561 396/428 |
| 2014/0311057 | A1* | 10/2014 | Puetz | E04H 12/182 52/111 |
| 2015/0023017 | A1* | 1/2015 | Smith | F21L 13/00 362/249.03 |
| 2016/0301128 | A1* | 10/2016 | Blackwelder | E04H 12/003 |
| 2022/0379148 | A1* | 12/2022 | Strauss | B66C 23/166 |
| 2023/0050712 | A1* | 2/2023 | Wasson | E04H 12/182 |
| 2023/0294845 | A1* | 9/2023 | Pupille | B64G 1/2226 244/172.6 |
| 2024/0125159 | A1* | 4/2024 | Renard | B64D 29/06 |
| 2024/0337912 | A1* | 10/2024 | Duan | F16M 11/28 |

FOREIGN PATENT DOCUMENTS

| | | | |
|---|---|---|---|
| GB | 244883 | A | 12/1925 |
| JP | 2000296997 | A | 10/2000 |

* cited by examiner

TELESCOPING MAST ASSEMBLY WITH STOP DEVICE

CROSS-REFERENCE TO RELATED APPLICATION(S)

This application claims priority to U.S. Application No. 63/464,114, filed on May 5, 2023, entitled TELESCOPING MAST ASSEMBLY WITH STOP DEVICE, the disclosure of which is hereby incorporated by reference in its entirety.

BACKGROUND

Portable light towers are known and are used to arrange lights in areas in need of illumination. Often, it is useful to elevate the lights in order to illuminate a greater area. Portable light towers use mast assemblies to raise lights into the air for this purpose.

Some mast assemblies are made of multiple telescoping pieces that can be raised into an extended position and lowered into a retracted position. The telescoping pieces of the mast assembly may be raised or lowered using a winch and cable system. Over time, the cable used to raise or lower the mast assembly may fray or snap from damage caused by use or misuse of the mast assembly. This can cause the mast assembly to rapidly move from an extended position into a retracted position. This rapid movement from the extended position to the retracted position is an undesirable quality of the mast assembly.

SUMMARY

In general terms, this disclosure is directed to a telescoping mast assembly with stop device. In some embodiments, and by non-limiting example, the telescoping mast assembly with stop device includes a telescoping mast assembly and a stop device. The telescoping mast assembly includes multiple pillars, one or more of which is able to be moved between an extended position and a retracted position. The stop device is mountable to the telescoping mast assembly and functions to prevent the rapid movement of the telescoping mast assembly from the extended position to the retracted position.

In some embodiments, the telescoping mast assembly comprises an outer pillar with a hollow interior, the outer pillar having at least one opening in a sidewall thereof. The telescoping mast assembly further comprises an inner pillar slidable within the hollow interior of the outer pillar, the inner pillar including at least one engagement feature in a sidewall thereof. The telescoping mast assembly further comprises a stop mounted on the sidewall of the outer pillar, the stop including a movable portion. The movable portion comprises a pin extending through the at least one opening of the outer pillar and a pulley affixed to the pin. The movable portion is movable between an engaged position in which the pin is engaged with the engagement feature and the pulley is arranged at a first distance from the outer pillar, and a disengaged position in which the pin is not engaged with the engagement feature and the pulley is arranged at a second distance from the outer pillar, wherein the first distance is less than the second distance.

In some embodiments, a stop device for a telescoping mast assembly comprises a fixed portion including a tube with an opening. The stop device further comprises a movable portion including a pulley assembly and a pin that extends through the opening. The movable portion is movable between an engaged position in which the pin extends a first distance out of the opening and a disengaged position in which the pin extends a second distance out of the opening.

DETAILED DESCRIPTION

Figure 1:
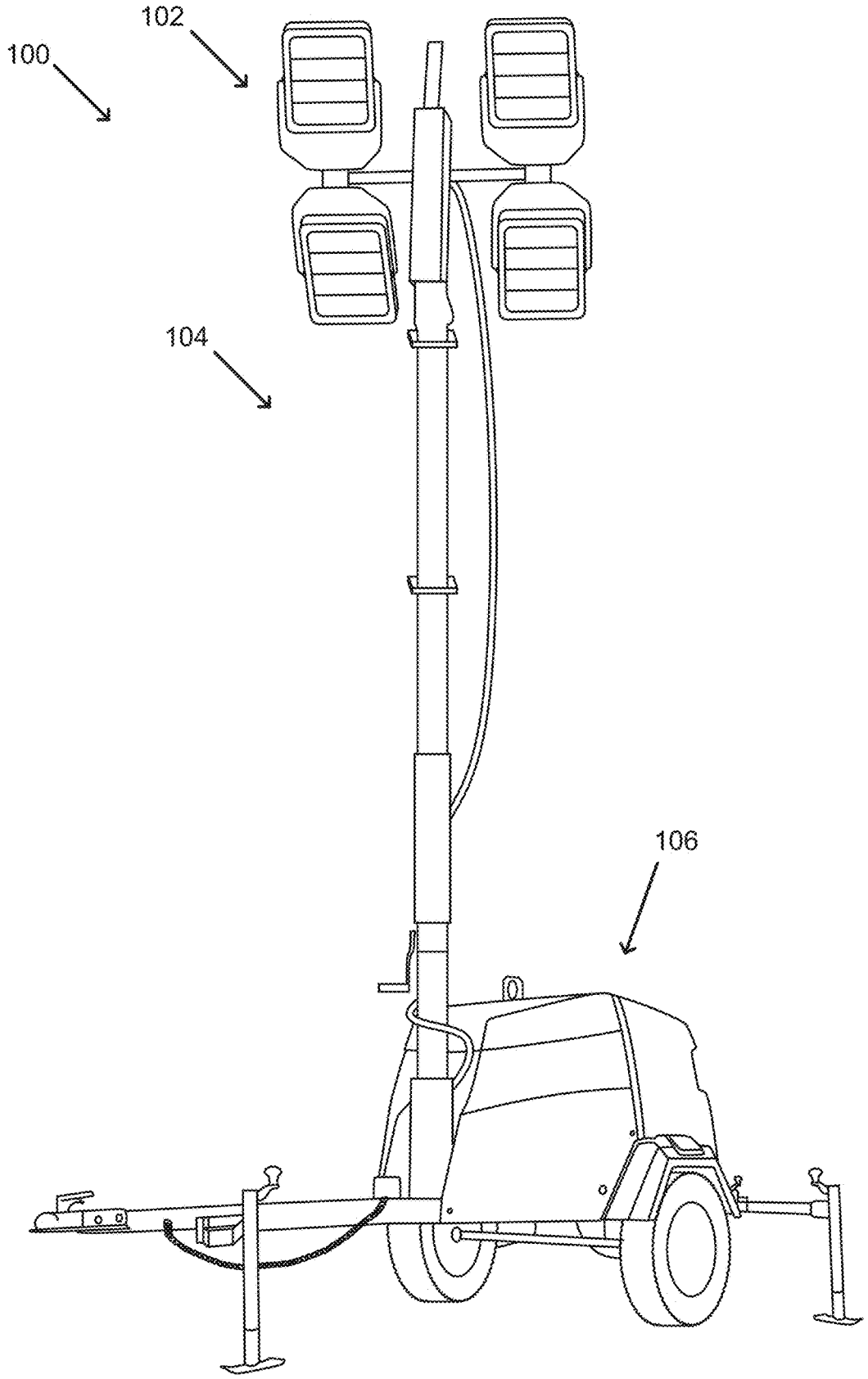
FIG. 1 is a perspective view of an example telescoping tower in an extended position.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

FIG. 1 is a perspective view of a telescoping tower 100 in an extended position. In some examples, as shown in FIG. 1, the telescoping tower 100 is a telescoping light tower. In some examples, the telescoping tower 100 includes a light 102, telescoping mast 104, and a trailer 106. In some examples, the light 102 is connected to the top of the telescoping mast 104 and the trailer 106 is connected to the bottom of the telescoping mast 104. In some examples, the telescoping mast 104 allows for the light 102 to be raised into the air above an illumination point. In some examples, the telescoping mast 104 allows for the light 102 to be raised up into the air into an adjustable level.

Figure 2:
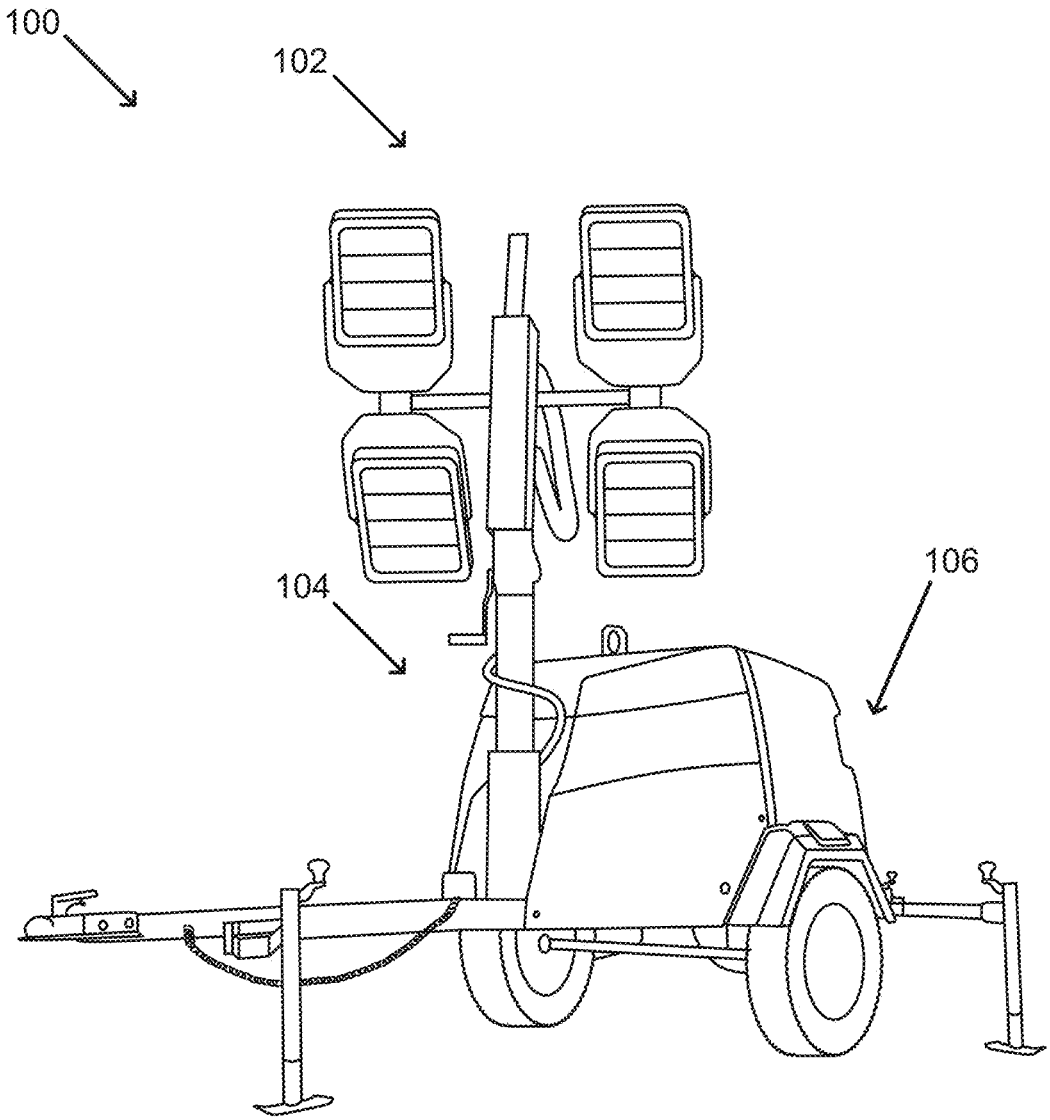
FIG. 2 is a perspective view of the telescoping tower of FIG. 1 in a retracted position.

FIG. 2 is a perspective view of the telescoping tower 100 of FIG. 1 in a retracted position. As shown in FIG. 2, the telescoping tower 100 may be collapsed into the retracted position in order to transport or store the telescoping tower 100. In some examples, the telescoping tower 100 is placed into the retracted position by causing the telescoping mast 104 to retract into itself. In some examples, the trailer 106 allows for the telescoping tower 100 to be transported when it is placed into the retracted position.

Figure 3:
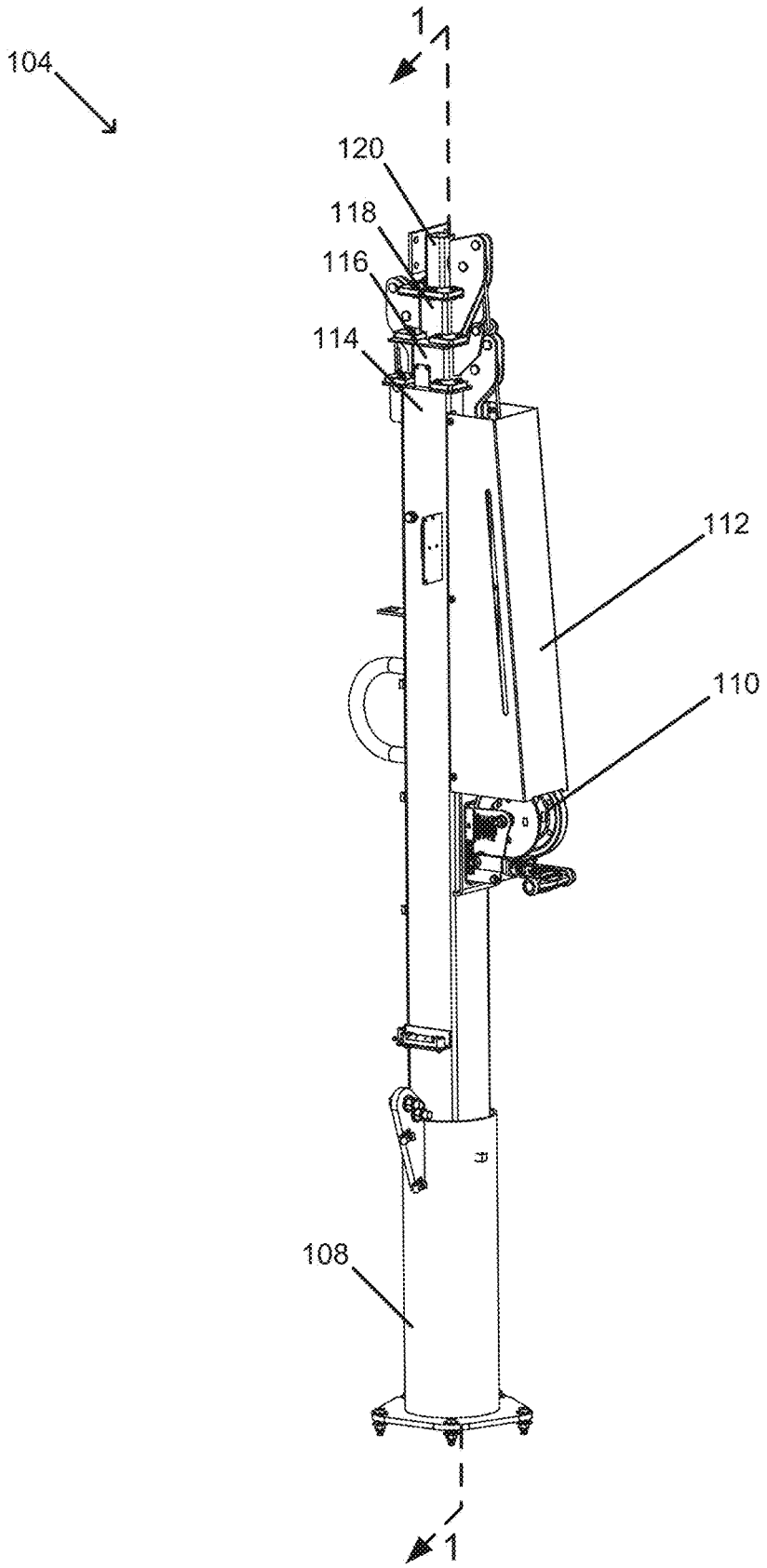
FIG. 3 is a perspective view of an example telescoping mast in a retracted position.

FIG. 3 is a perspective view of the telescoping mast 104 of the telescoping tower 100. The telescoping mast 104 includes a base 108, a winch 110, a cover 112, a first pillar 114, a second pillar 116, a third pillar 118, and a fourth pillar 120.

As shown in FIG. 3, the base 108 is arranged at the bottom of the telescoping mast 104. In some examples, the base 108 is connected to the trailer 106 of FIGS. 1-2.

In some examples, the first pillar 114 includes a bottom and a top end. The base 108 is connected to the first pillar 114 at the bottom end of the first pillar 114. The first pillar 114 extends from the bottom of the telescoping mast 104 towards an upper portion of the telescoping mast 104. The first pillar 114 is a hollow structure with an interior space. In some examples, the first pillar 114 includes an opening at the top end thereof which permits access into the interior space of the first pillar 114. In some examples, the first pillar 114 is an outer pillar.

In some examples, the second pillar 116 includes a bottom and a top end. The second pillar 116 is arranged within the interior space of the first pillar 114. The second pillar 116 is slidable within the interior space of the first pillar 114 between an extended position (in which the bottom end of the second pillar 116 is arranged adjacent to the top end of the first pillar 114, such as, for example, near the top end of the first pillar 114 or slightly below the top end of the first pillar 114) and a retracted position (in which the bottom end of the second pillar 116 is arranged adjacent to the bottom end of the first pillar 114, such as, for example, near the bottom end of the first pillar 114 or slightly above the bottom end of the first pillar 114). In some examples, the second pillar 116 extends through and out of the opening at the top end of the first pillar 114. In some examples, the second pillar 116 is a hollow structure with an interior space. In some examples, the second pillar 116 includes an opening at the top end thereof which permits access into the interior space of the second pillar 116. In some examples, the second pillar 116 is an inner pillar.

In some examples, the third pillar 118 includes a bottom and a top end. The third pillar 118 is arranged within the interior space of the second pillar 116. The third pillar 118 is slidable within the interior space of the second pillar 116 between an extended position (in which the bottom end of the third pillar 118 is arranged adjacent to the top end of the second pillar 116, such as, for example, near the top end of the second pillar 116 or slightly below the top end of the second pillar 116) and a retracted position (in which the bottom end of the third pillar 118 is arranged adjacent to the bottom end of the second pillar 116, such as, for example, near the bottom end of the second pillar 116 or slightly above the bottom end of the second pillar 116). In some examples, the third pillar 118 extends through and out of the opening at the top end of the second pillar 116. In some examples, the third pillar 118 is a hollow structure with an interior space. In some examples, the third pillar 118 includes an opening at the top end thereof which permits access into the interior space of the third pillar 118.

In some examples, the fourth pillar 120 includes a bottom and a top end. The fourth pillar 120 is arranged within the interior space of the third pillar 118. The fourth pillar 120 is slidable within the interior space of the third pillar 118 between an extended position (in which the bottom end of the fourth pillar 120 is arranged adjacent to the top end of the third pillar 118, such as, for example, near the top end of the third pillar 118 or slightly below the top end of the third pillar 118) and a retracted position (in which the bottom end of the fourth pillar 120 is arranged adjacent to the bottom end of the third pillar 118, such as, for example, near the bottom end of the third pillar 118 or slightly above the bottom end of the third pillar 118). In some examples, the fourth pillar 120 extends through and out of the opening at the top end of the third pillar 118.

The winch 110 is located at a fixed position on the telescoping mast 104. In some examples, the winch 110 is mounted to the side of the first pillar 114. In some examples, as depicted in the example of FIG. 3, the winch is a manual style winch for pulling one or more cables that cause the second pillar 116, the third pillar 118, and/or the fourth pillar 120 to move into an extended position. In some examples, the winch includes an automatic lock, which permits the winch to spool cable in a first direction, but prevents the winch from unspooling cable in a second direction. In some examples, such a lock prevents the sudden unspooling of cable, which could result in the rapid movement of the components of the telescoping mast 104 from the extended position into the retracted position. In some examples, the winch 110 is configured with a brake such that it is unable to turn by itself and instead requires user input to manually turn the winch 110.

In some examples, the cover 112 is located adjacent to the winch 110. The cover 112 covers a portion of the cable that runs from the winch 110. In some examples, the cover 112 prevents debris or other obstacles from contacting or obstructing the cable.

Figure 4:
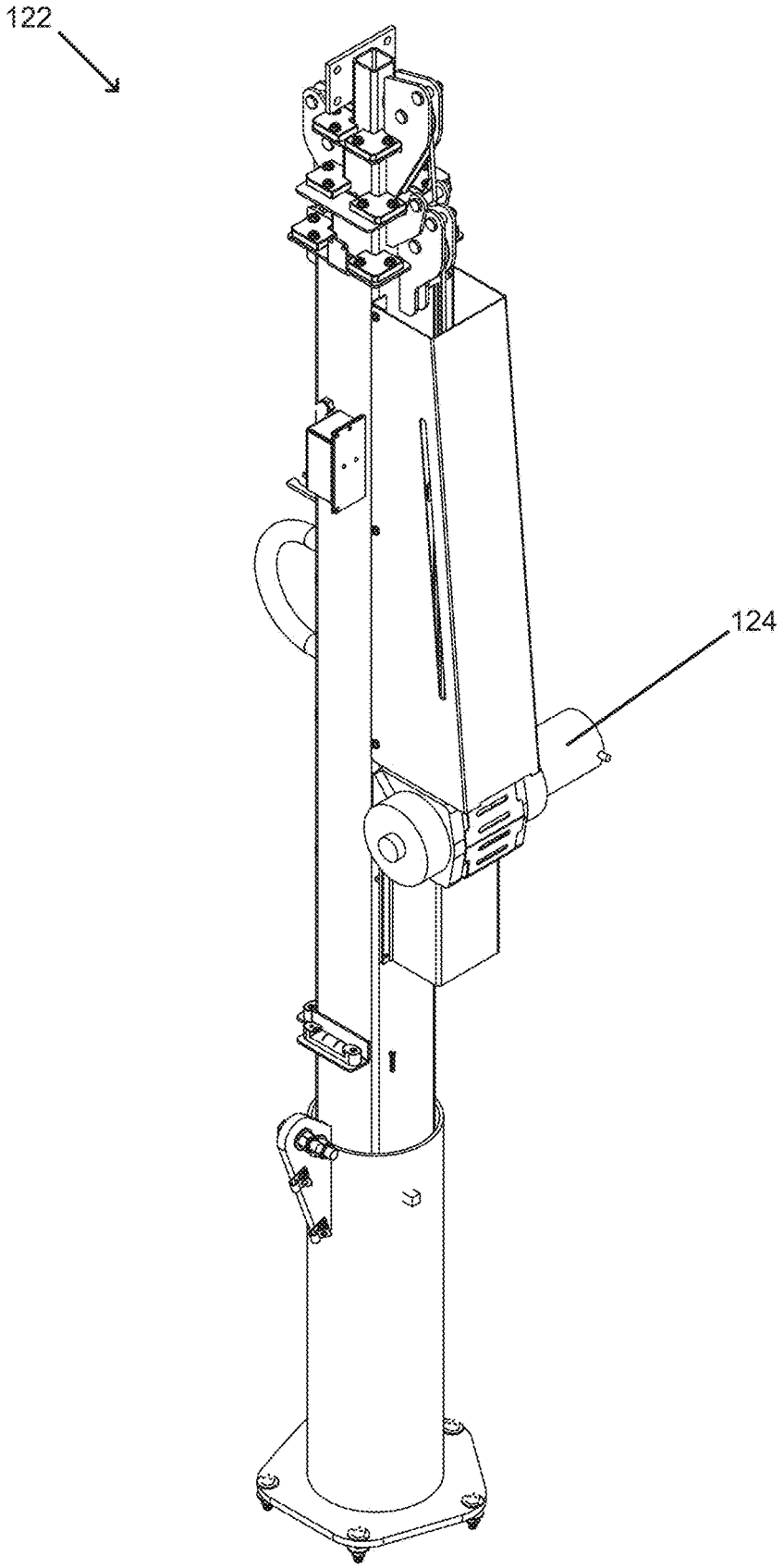
FIG. 4 is a perspective view of another example telescoping mast in a retracted position.

FIG. 4 is another perspective view of a second embodiment of the telescoping mast 122. In some examples, as shown in FIG. 4, the telescoping mast 122 is similar in many aspects to the telescoping mast 104. In some embodiments, the telescoping mast 122 includes a motorized winch 124 as opposed to the manual style winch 110 of the telescoping mast 104. Although primarily discussed with reference to the telescoping mast 104, in some embodiments, the concepts of the present disclosure are implemented within the telescoping mast 122 in a substantially similar manner.

Figure 5:
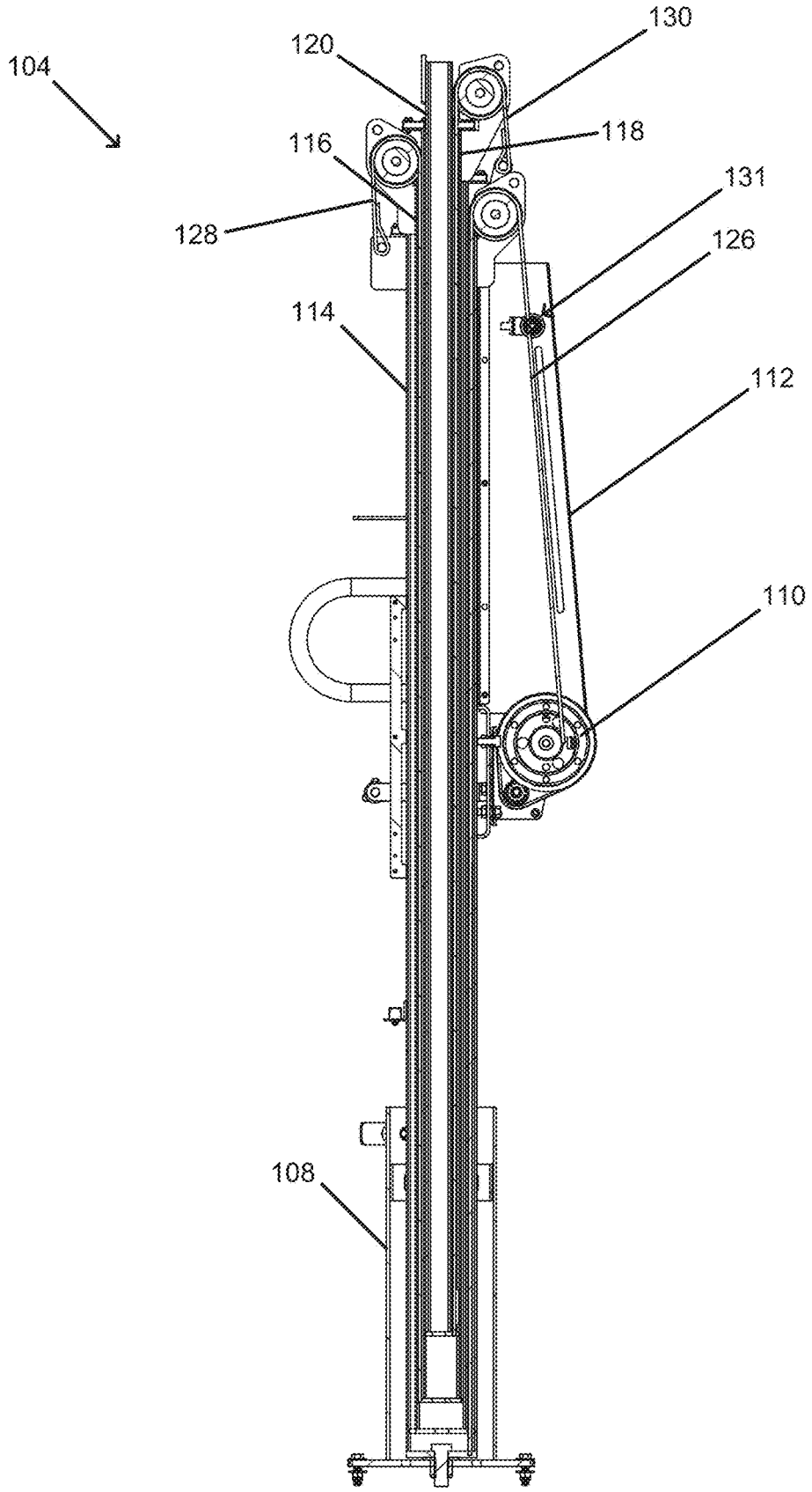
FIG. 5 is a cross-sectional view of the telescoping mast of FIG. 3 in the retracted position.

FIG. 5 is a cross-sectional view of the telescoping mast 104 of FIG. 3, taken along line 1. As shown in FIG. 5, and previously explained with respect to FIG. 3, the telescoping mast 104 includes the first pillar 114, the second pillar 116, the third pillar 118, and the fourth pillar 120. In some examples, the telescoping mast further includes a first cable 126, a second cable 128, and a third cable 130. In some examples, the telescoping mast 104 further includes a stop 131.

In some examples, the first cable 126 is connected to the winch 110 at a first end and the second pillar 116 at a second end. The second cable 128 is connected to the first pillar 114 at a first end and the third pillar 118 at a second end. The third cable 130 is connected to the second pillar 116 at a first end and a fourth pillar 120 at a second end. In some examples, the first cable 126 is used to hoist the second pillar 116 into the extended position, the second cable 128 is used to hoist the third pillar 118 into the extended position, and the third cable 130 is used to hoist the fourth pillar 120 into the extended position.

In some examples, the stop 131 functions to restrict the movement of the telescoping mast 104 from moving between the extended position and the retracted position. In some examples, the stop 131 is selectively engaged such that when the stop 131 is disengaged the telescoping mast 104 is free to move between the extended position and the retracted position, and when the stop 131 is engaged the telescoping mast 104 is unable to move between the extended position and the retracted position. In some examples, the stop 131 is covered by the cover 112.

Figure 6:
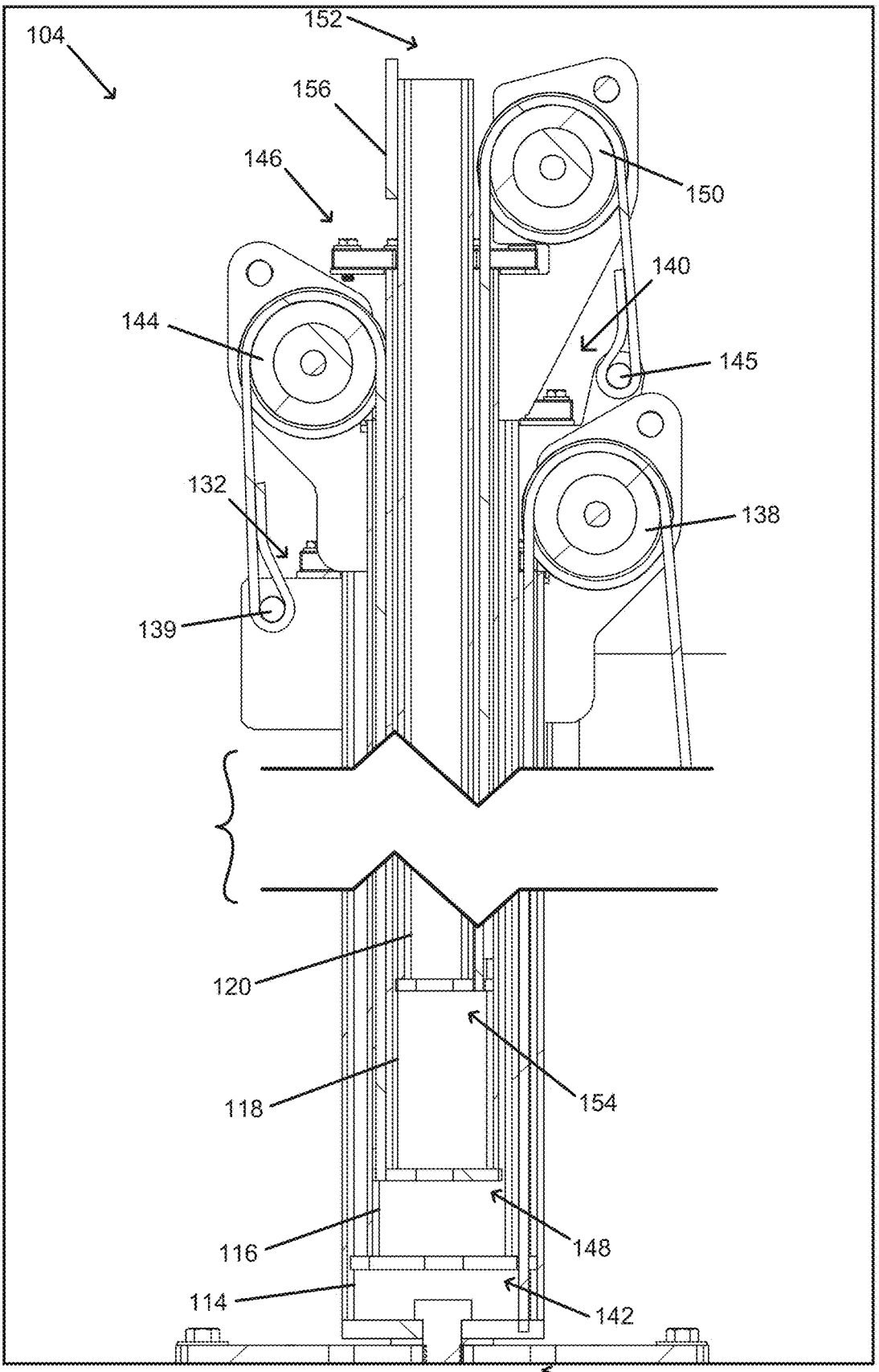
FIG. 6 is another cross-sectional view of portions of the telescoping mast of FIG. 3 in the retracted position.

FIG. 6 is a detailed view of the first pillar 114, the second pillar 116, the third pillar 118, and the fourth pillar 120 of the telescoping mast 104.

As shown in FIG. 6, the first pillar 114 includes a top end 132, a bottom end 134, a first pulley 138, and a second cable attachment point 139. In some examples, the first pulley 138 and the second cable attachment point 139 are each mounted at the top end 132 of the first pillar 114. In some examples, the first pulley 138 is mounted on a sidewall of the first pillar 114 on the same side of the first pillar 114 as the winch 110 or winch 124.

The second pillar 116 includes a top end 140, a bottom end 142, a second pulley 144, and a third cable attachment point 145. In some examples, the second pulley 144 and third cable attachment point 145 are each mounted at the top end 140 of the second pillar 116. In some examples, as the second pillar 116 is raised into the extended position, the second pulley 144 and third cable attachment point 145 raise with the top end 140 of the second pillar 116.

The third pillar 118 includes a top end 146 and a bottom end 148. In some examples, the third pillar 118 includes a third pulley 150 mounted at the top end 146 thereof. In some examples, as the third pillar 118 is raised into the extended position, the third pulley 150 raises with the top end 146 of the third pillar 118.

The fourth pillar 120 includes a top end 152 and a bottom end 154. In some examples, the fourth pillar 120 includes a plate 156 mounted at the top end 152 thereof. In some examples, the plate 156 is used to connect lights to the top end 152 of the fourth pillar 120. In some examples, as the fourth pillar 120 is raised into the extended position, the plate 156 raises with the top end 152 of the fourth pillar 120.

Figure 7:
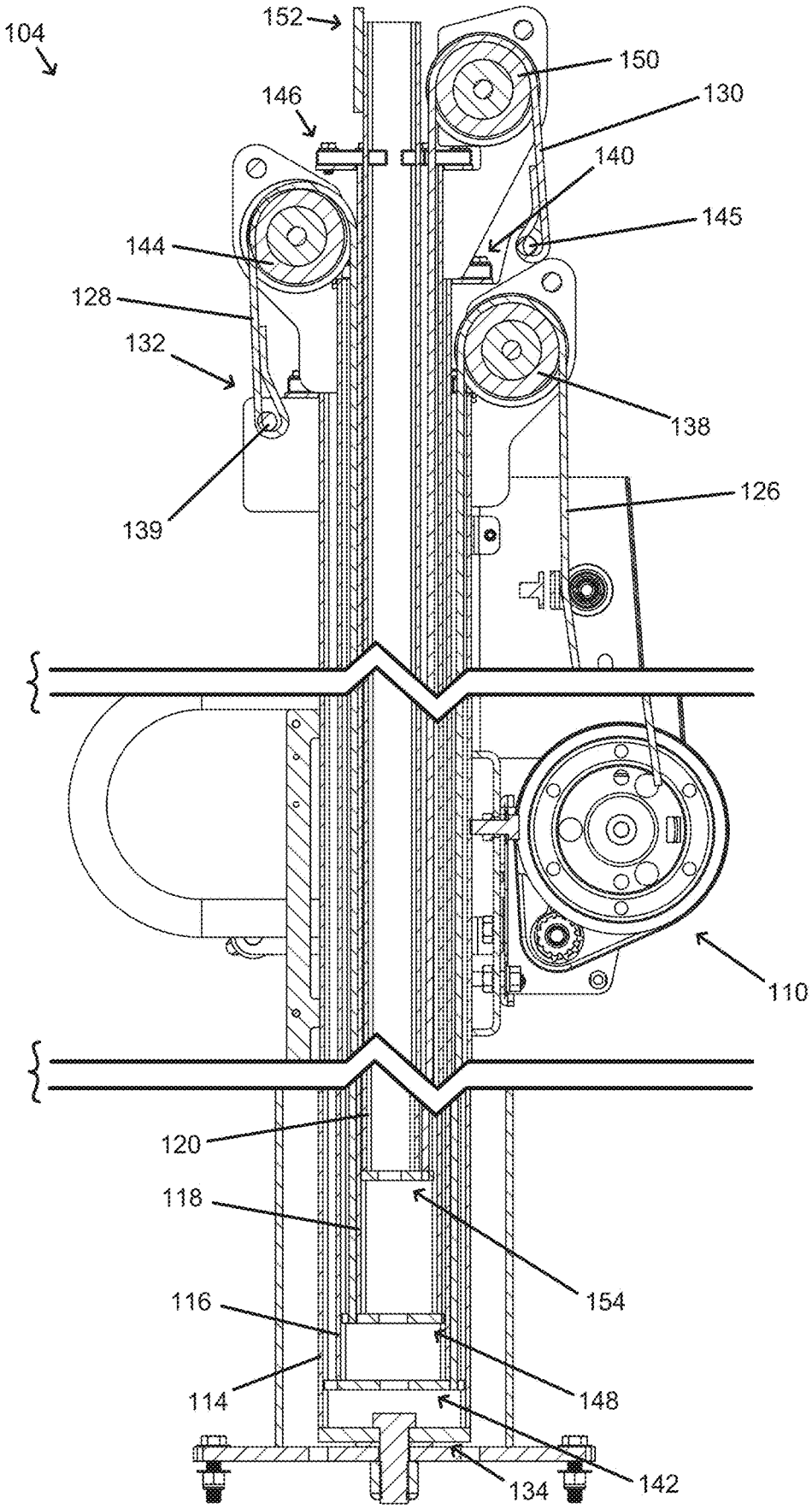
FIG. 7 is another cross-sectional view of portions of the telescoping mast of FIG. 3 in the retracted position.

FIG. 7 is a detail view of the first pillar 114, the second pillar 116, the third pillar 118, and the fourth pillar 120, along with cables 126, 128, 130, of the telescoping mast 104 in the retracted position.

Figure 8:
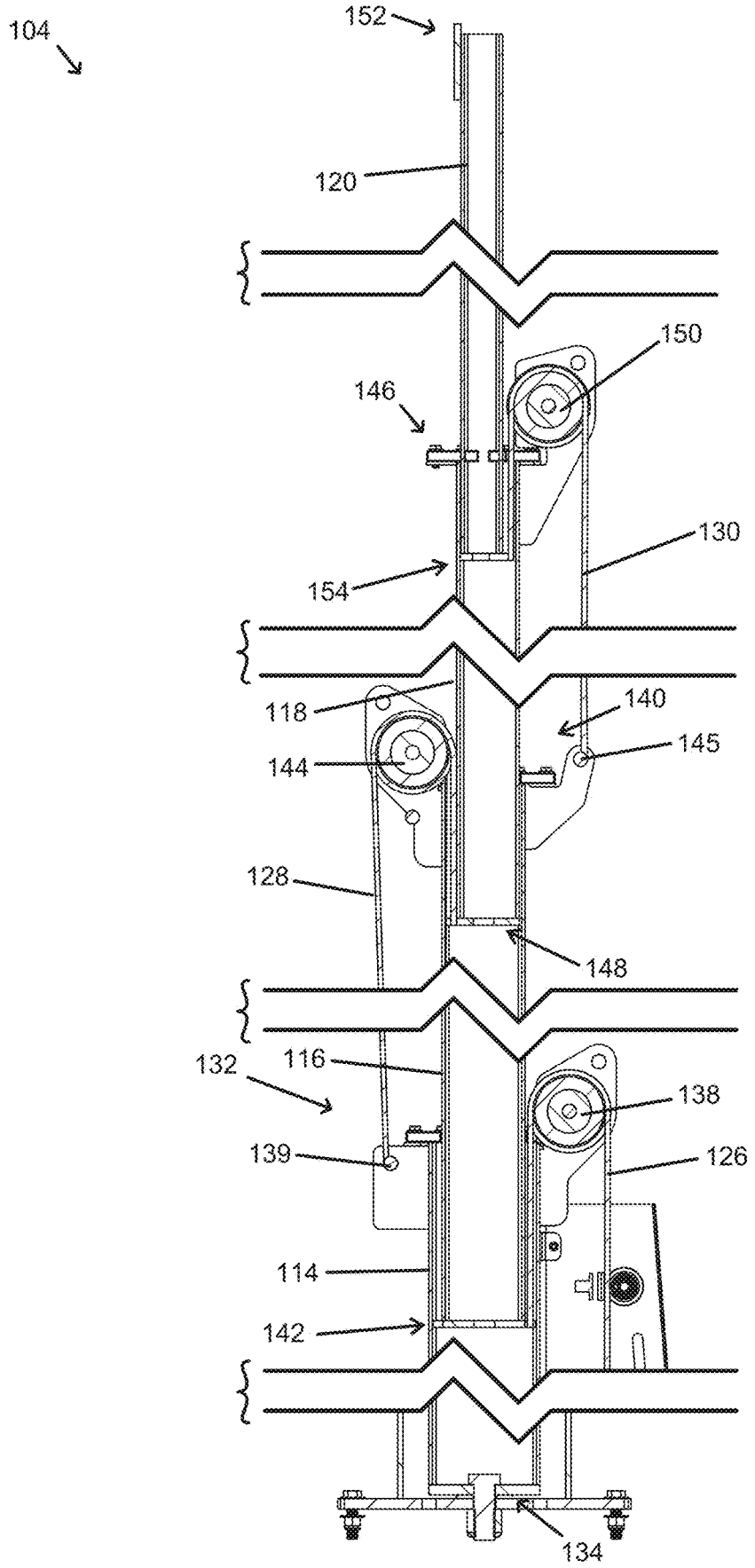
FIG. 8 is another cross-sectional view of portions of the telescoping mast of FIG. 3 in the extended position.

FIG. 8 is a detail view of the first pillar 114, the second pillar 116, the third pillar 118, and the fourth pillar 120, along with cables 126, 128, 130, of the telescoping mast 104 in the extended position.

As shown in FIG. 7 and FIG. 8, the first cable 126 is connected to the winch 110 at a first end and is routed over the top of the first pulley 138 at the top of the first pillar 114. The first cable 126 is then routed through the interior of the first pillar 114 and is connected to the bottom end 142 of the second pillar 116.

The second cable 128 is connected to the second cable attachment point 139 at the top of the first pillar 114 and is routed over the top of the second pulley 144 at the top of the second pillar 116. The second cable 128 is then routed through the interior of the second pillar 116 and is connected to the bottom end 148 of the third pillar 118.

The third cable 130 is connected to the third cable attachment point 145 at the top end of the second pillar 116 and is routed over the top of the third pulley 150 at the top of the third pillar 118. The third cable 130 is then routed through the interior of the third pillar 118 and is connected to the bottom end 154 of the fourth pillar 120.

As previously noted, the first cable 126, second cable 128, and third cable 130 work together to raise the telescoping mast 104 into the extended position.

As the first cable 126 is spooled onto the winch 110, the effective length of the first cable 126 is decreased. This causes the first cable 126 to lift the bottom end 142 of the second pillar 116 upward toward the first pulley 138 at the top end 132 of the first pillar 114. Thus, the second pillar 116 is drawn into the extended position.

As the second pillar 116 is drawn into the extended position, the second pulley 144 raises with the top end 140 of the second pillar 116 while the second cable attachment point 139 remains fixed and stationary at the top end 132 of the first pillar 114. This causes the distance between the second pulley 144 and the second cable attachment point 139 to increase. As the distance between the second pulley 144 and the second cable attachment point 139 increases, the bottom end 148 of the third pillar 118 is drawn toward the second pulley 144 at the top end 140 of the second pillar 116. Thus, the third pillar 118 is drawn into the extended position.

As the third pillar 118 is drawn into the extended position, the third pulley 150 raises with the top end 146 of the third pillar 118 while the third cable attachment point 145 remains fixed at the top end 140 of the second pillar 116. This causes the distance between the third pulley 150 and the third cable attachment point 145 to increase. As the distance between the third pulley 150 and the third cable attachment point 145 increases, the bottom end 154 of the fourth pillar 120 is drawn towards the third pulley 150 at the top end 152 of the third pillar 118. Thus, the fourth pillar 120 is drawn into the extended position.

Figure 9:
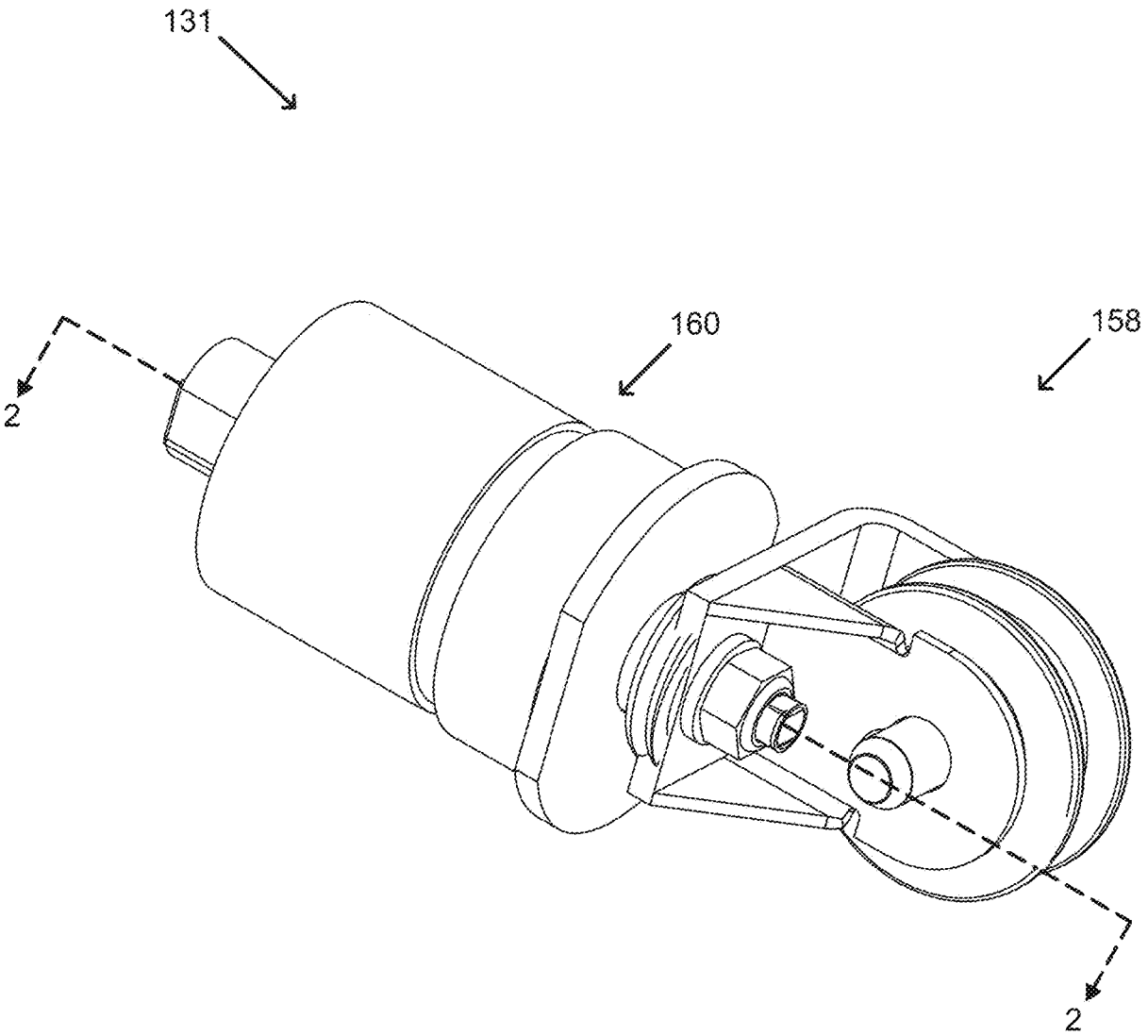
FIG. 9 is a perspective view of an example stop.

FIG. 9 is a perspective view of the stop 131 of FIG. 5. In some examples, the stop includes a moving portion 158 and a fixed portion 160. In some examples, when the stop 131 is mounted to the first pillar 114 of the telescoping mast 104, the moving portion 158 is movable with respect to the first pillar 114 between an engaged and a disengaged position, while the fixed portion 160 is fixed to the first pillar 114 and stationary with respect to the first pillar 114.

Figure 10:
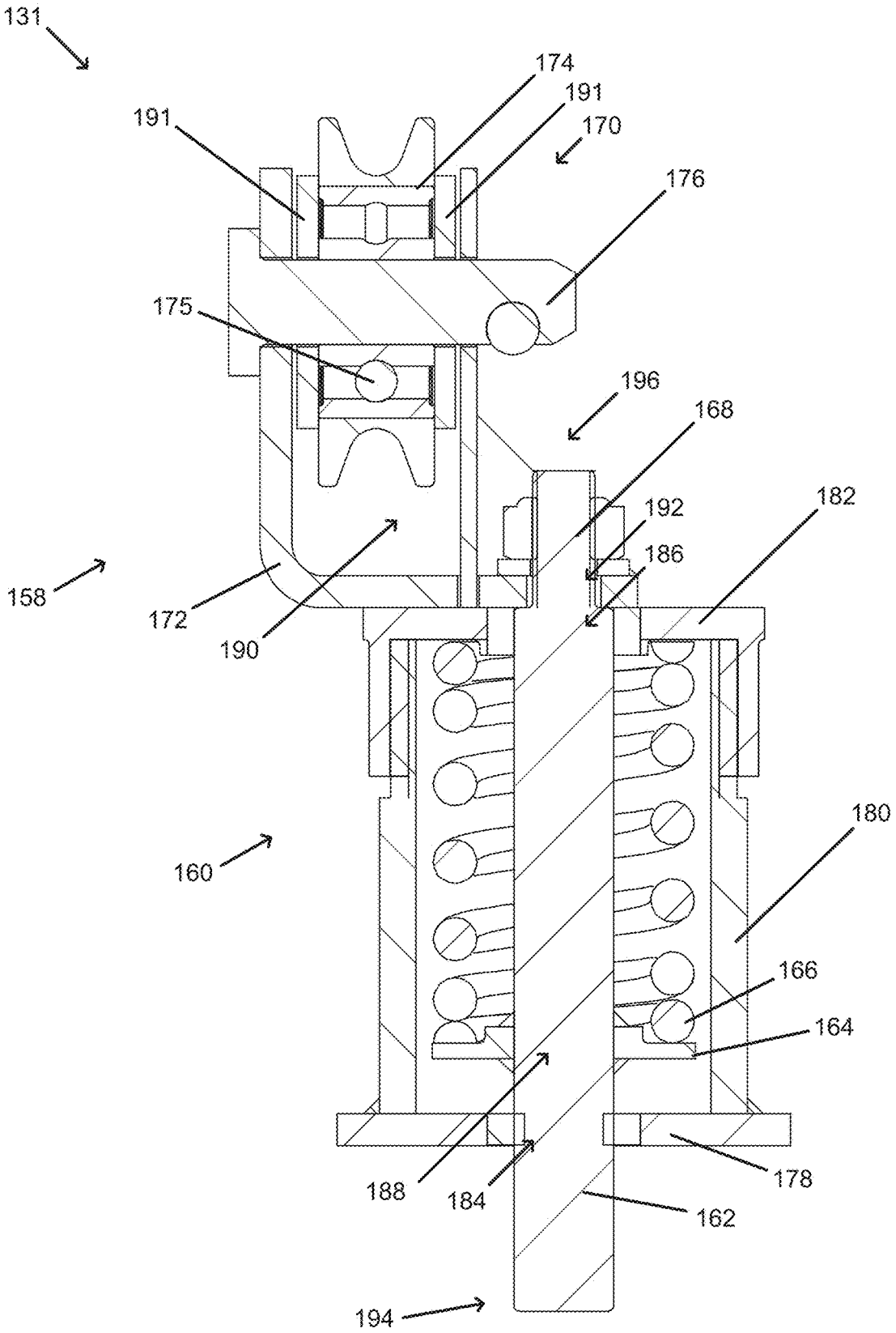
FIG. 10 is a cross-sectional view of the stop of FIG. 9 in an engaged position.

FIG. 10 is a cross-sectional view of the stop 131, taken along line 2 of FIG. 9, with the moving portion 158 shown in the engaged position.

In some examples, the moving portion 158 of the stop 131 includes a pin 162, a moving plate 164, a spring 166, a nut 168, and a pulley assembly 170. The pulley assembly includes a bracket 172, a pulley 174, and an axel 176. In some examples, the pulley assembly further includes a bearing/bushing 175 and/or a spacer 191. The bracket 172 includes a pulley space 190 and a mounting hole 192. In some examples, the moving plate 164 includes a central hole 188. In some examples, the moving plate 164 is formed as a single piece with the pin 162.

In some examples, the fixed portion 160 includes a tube 180 and a cap 182. In some examples, the fixed portion 160 further includes a fixed plate 178. In some examples, the fixed plate 178 is a separate component attached to the tube 180. In some examples, the fixed plate 178 is formed as an integral structure with the tube 180. In some examples, the tube 180 includes a first end and a second end, each having an opening therein. In some examples, the fixed plate 178 includes a central hole 184 and the cap 182 includes a central hole 186. In some examples, the fixed plate 178 is mounted to the sidewall of the first pillar 114. In some examples, the fixed portion 160 does not include a separate fixed plate 178 such that a first end of the tube 180 is mounted directly to the sidewall of the first pillar 114. In such examples, the sidewall of the first pillar 114 comprises the fixed plate 178. In some examples, the tube 180 is mounted onto the fixed plate 178 at the first end of the tube 180, coaxial with the central hole 184. The tube 180 extends out from the fixed plate 178. The cap 182 is arranged over the tube 180 at the second end of the tube 180. In some examples, the cap 182 is arranged over the tube 180 at the second end of the tube 180 opposite the fixed plate 178. In some examples, the cap 182 is secured by threads to the tube 180 at the second end of the tube 180. In some examples, the tube 180 includes one or more drainage holes arranged therein to allow water to drain out of the interior space of the tube 180.

In some examples, the moving plate 164 is arranged within the tube 180 and is oriented in a plane that is parallel to a plane of the first end of the tube 180. In some examples, the moving plate 164 is oriented in a plane that is parallel to a plane of the fixed plate 178. In some examples, the spring 166 is also arranged within the tube 180. The spring 166 contacts the cap 182 at a first end and the moving plate 164 at a second end. In some examples, the bracket 172 is arranged adjacent the cap 182 such that the mounting hole 192 of the bracket 172 is arranged coaxially with the central hole 186 of the cap 182. In some examples, the spring 166 is a compression spring.

In some examples, the pin 162 extends through the interior of the tube 180, through the central hole of the cap 182, through the center of the spring 166, through the central hole 188 of the moving plate 164, through the central hole 184 of the fixed plate 178, and through the mounting hole 192 of the bracket 172. In some examples, the pin 162 extends through the interior of the tube 180, through the central hole of the cap 182, through the center of the spring 166 and through the mounting hole 192 of the bracket 172. In some examples, the pin 162 is fixed to the moving plate 164, along the length of the pin 162.

In some examples, the second end 196 of the pin 162 also extends through the mounting hole 192 on the bracket 172. In some examples, the second end 196 includes threads thereon. In some examples, the nut 168 is threaded onto the threads of the pin 162 such that the bracket 172, the cap 182, and the spring 166 are arranged between the nut 168 and the moving plate 164.

In some examples, the bracket 172 is structured such that the pulley 174 is offset from the pin 162, as shown in FIG. 10. In some examples, the bracket 172 is structured such that the pulley 174 is in line with the pin 162.

In some examples, when in the engaged position, the bracket 172 contacts the cap 182 and the moving plate 164 is spaced apart from the fixed plate 178. In other examples, when in the engaged position, the bracket 172 is spaced apart from the cap 182 and the moving plate 164 contacts the fixed plate 178. In some examples, when in the engaged position, the bracket 172 contacts the cap 182 and the moving plate 164 contacts the fixed plate 178.

Figure 11:
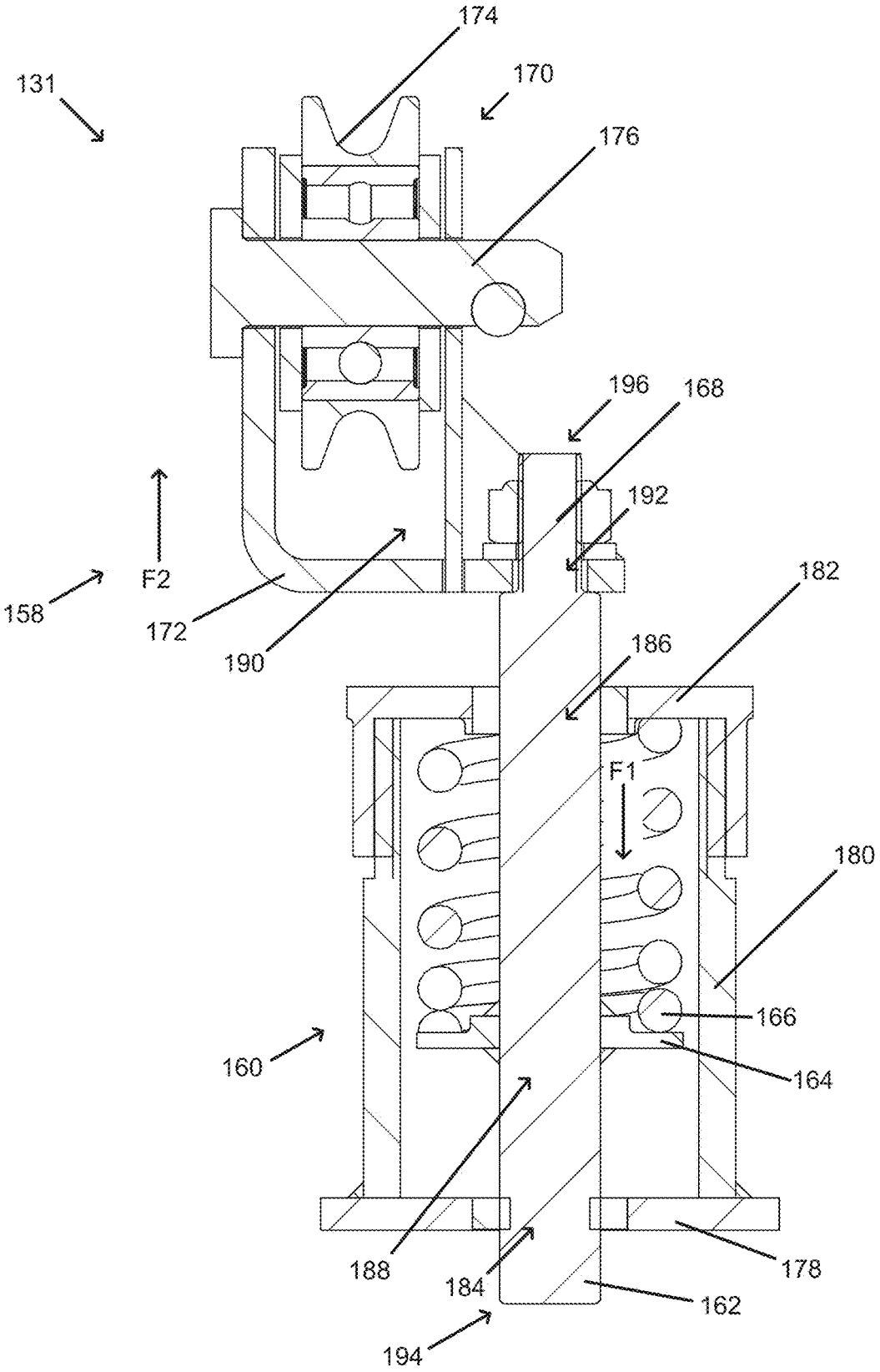
FIG. 11 is a cross-sectional view of the stop of FIG. 9 in a disengaged position.

FIG. 11 is another cross-sectional view of the stop 131, taken along line 2 of FIG. 9, with the moving portion 158 shown in the disengaged position. As shown in FIG. 11, when the moving portion 158 of the stop 131 is moved between the engaged position and the disengaged position, the pin 162, moving plate 164, nut 168, and pulley assembly 170 move with respect to the fixed portion 160. In some examples, when moved into the disengaged position, the pin 162 moves such that a portion of the pin 162 near the first end 194 recedes into the interior space of the tube 180 while a portion of the pin 162 near the second end 196 moves out from its position within the interior space of the tube 180. Meanwhile, the moving plate 164, which is secured to, or a part of, the pin 162, moves away from the fixed plate 178 within the interior of the tube 180 towards the cap 182. The pulley assembly 170 moves with the pin 162 in a direction away from the cap 182. The spring 166 is compressed between the cap 182 and the moving plate 164. In some examples, the spring 166 exerts a force F1 on the moving plate 164 in a direction towards the fixed plate 178 when the spring 166 is compressed. In some examples, in order to move the moving portion 158 into the disengaged position, a force F2 must be applied to the pulley assembly 170 to counter the force F1 exerted by the spring 166. In some examples, if the force F2 is removed or is smaller than the force F1, then the moving portion 158 moves into the engaged position. In some examples, when the moving portion 158 is moved into the disengaged position, the space between the bracket 172 and the cap 182 is increased and the space between the moving plate 164 and the fixed plate 178 is increased.

Figure 12:
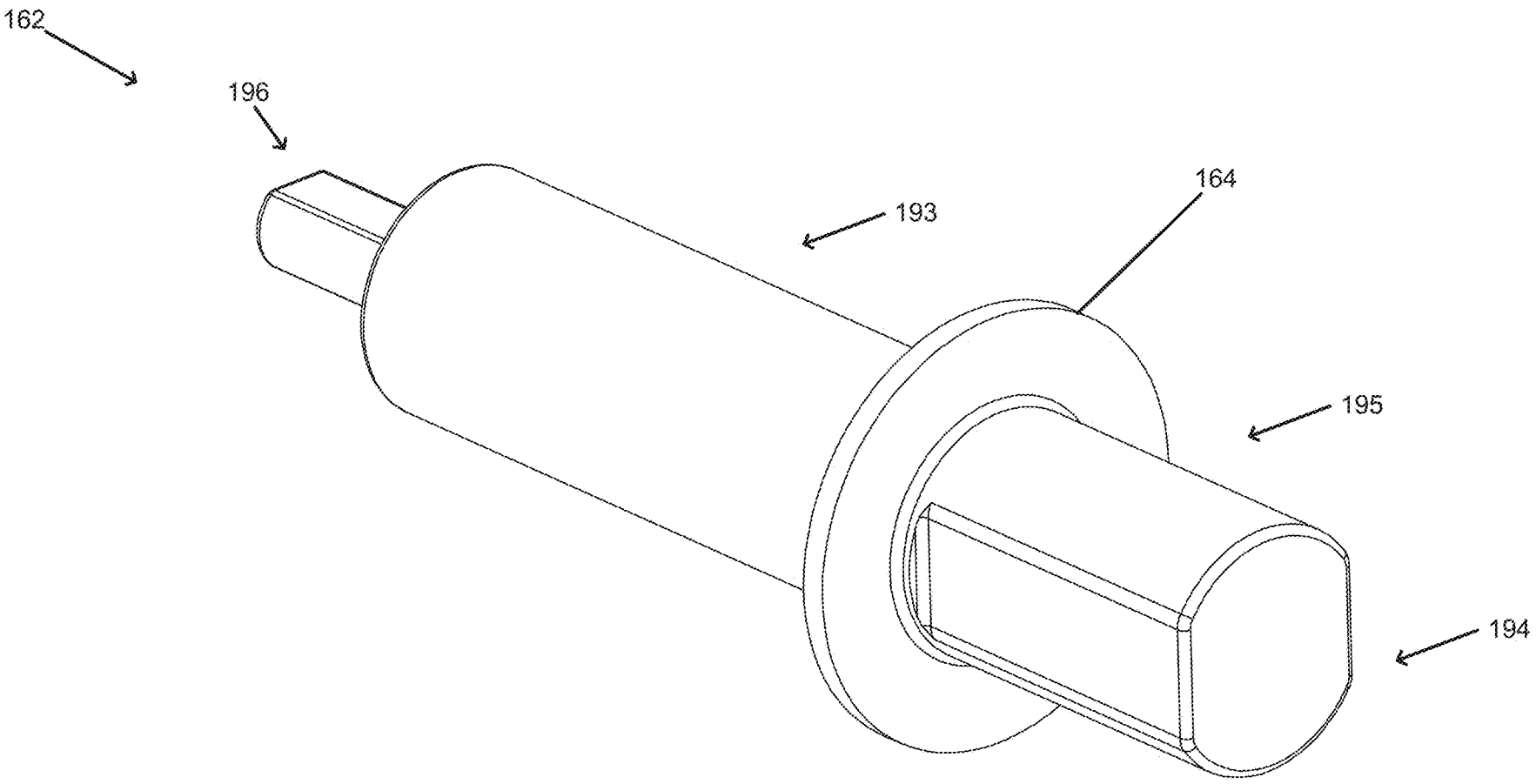
FIG. 12 is a perspective view of an example pin of the stop of FIG. 9.

FIG. 12 is a perspective view of the example pin 162. In some examples, such as the example of FIG. 12, the pin 162 is formed as an integral piece with the moving plate 164 such that the pin 162 comprises the moving plate 164. In some examples, the pin 162 includes a first end 194 and a second end 196 opposite the first end 194. In some examples, the first end 194 extends through the central hole 184 of the fixed plate 178 (see, for example, FIG. 10). In some examples, the second end 196 extends through the central hole 184 of the cap 182 (see, for example, FIG. 10). In some examples, the pin 162 is cylindrical in shape. In other examples, the pin 162 is ovular in shape. In some examples, one or more portions of the pin are about 0.375" in diameter, such as, for example, 0.375" in diameter. In some examples, the pin 162 comprises 1015 steel. In other examples, the pin 162 comprises 4340 steel, such as, for example, 4340 Q&T steel. In some examples, one or more portions of the pin 162 are about 0.561" in diameter, such as, for example, 0.561" in diameter. In some examples, the pin 162 comprises a cylindrical portion 193 that extends to the second end 196. In some examples, the pin 162 comprises a non-cylindrical portion 195 that extends to the first end 194. In some examples, as shown in the example of FIG. 11, one or more portions of the non-cylindrical portion 195 are squared off to form the non-cylindrical portion 195. In some examples, when assembled into the telescoping mast 104, the pin 162 is arranged such that the longitudinal axis of a cross section of the pin 162 is substantially parallel with a longitudinal axis of the telescoping mast 104. In other examples, when assembled into the telescoping mast 104, the pin 162 is arranged such that the longitudinal axis of a cross section of the pin 162 is substantially perpendicular to a longitudinal axis of the telescoping mast 104.

Figure 13:
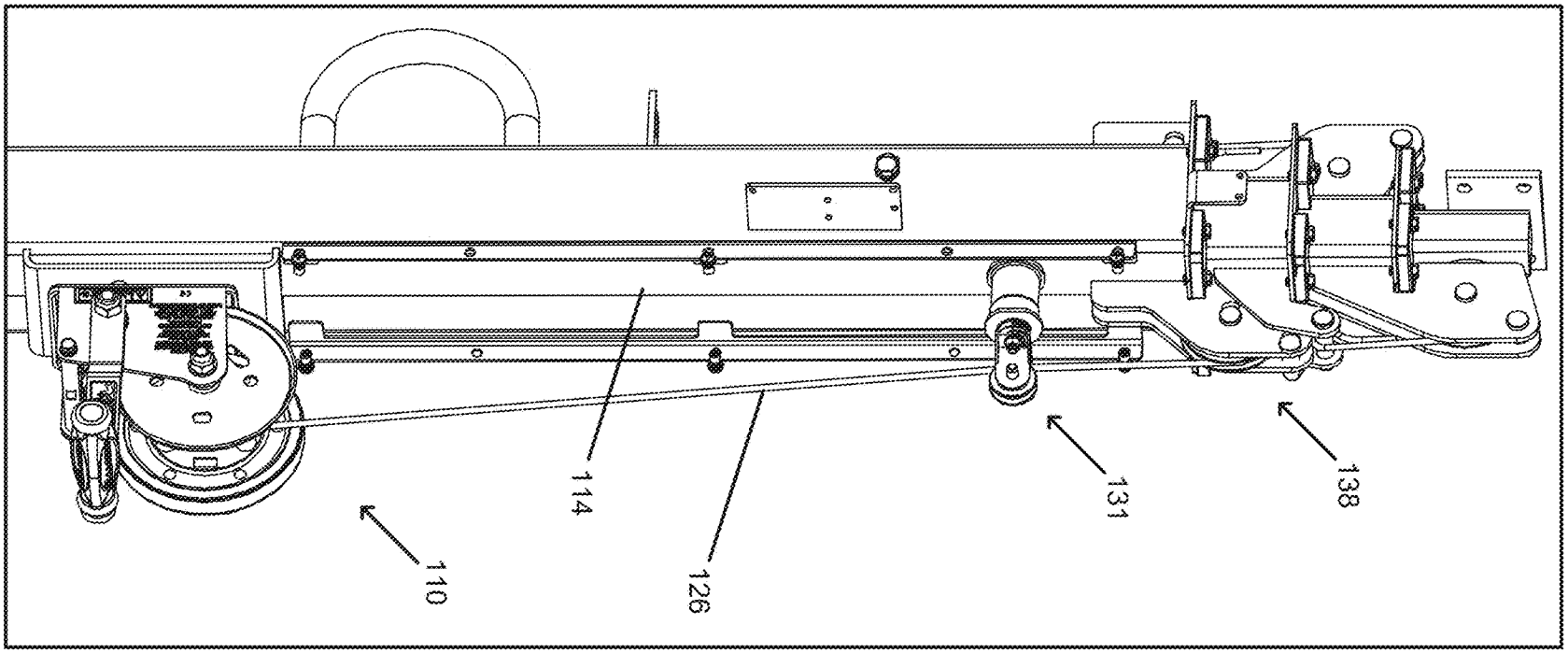
FIG. 13 is a perspective view of portions of the example telescoping mast of FIG. 3.

FIG. 13 is a perspective view of the stop 131 mounted in place on the telescoping mast 104. As shown in FIG. 13, in some examples, the stop 131 is mounted to the sidewall of the first pillar 114. In some examples, the stop 131 is mounted to the sidewall of first pillar 114 on the same side of the first pillar 114 that the winch 110 and the first pulley 138 are mounted to. In some examples, the stop 131 is arranged between the winch 110 and the first pulley 138 such that the first cable 126 extends from the winch 110, through the stop 131 to the first pulley 138.

Figure 14:
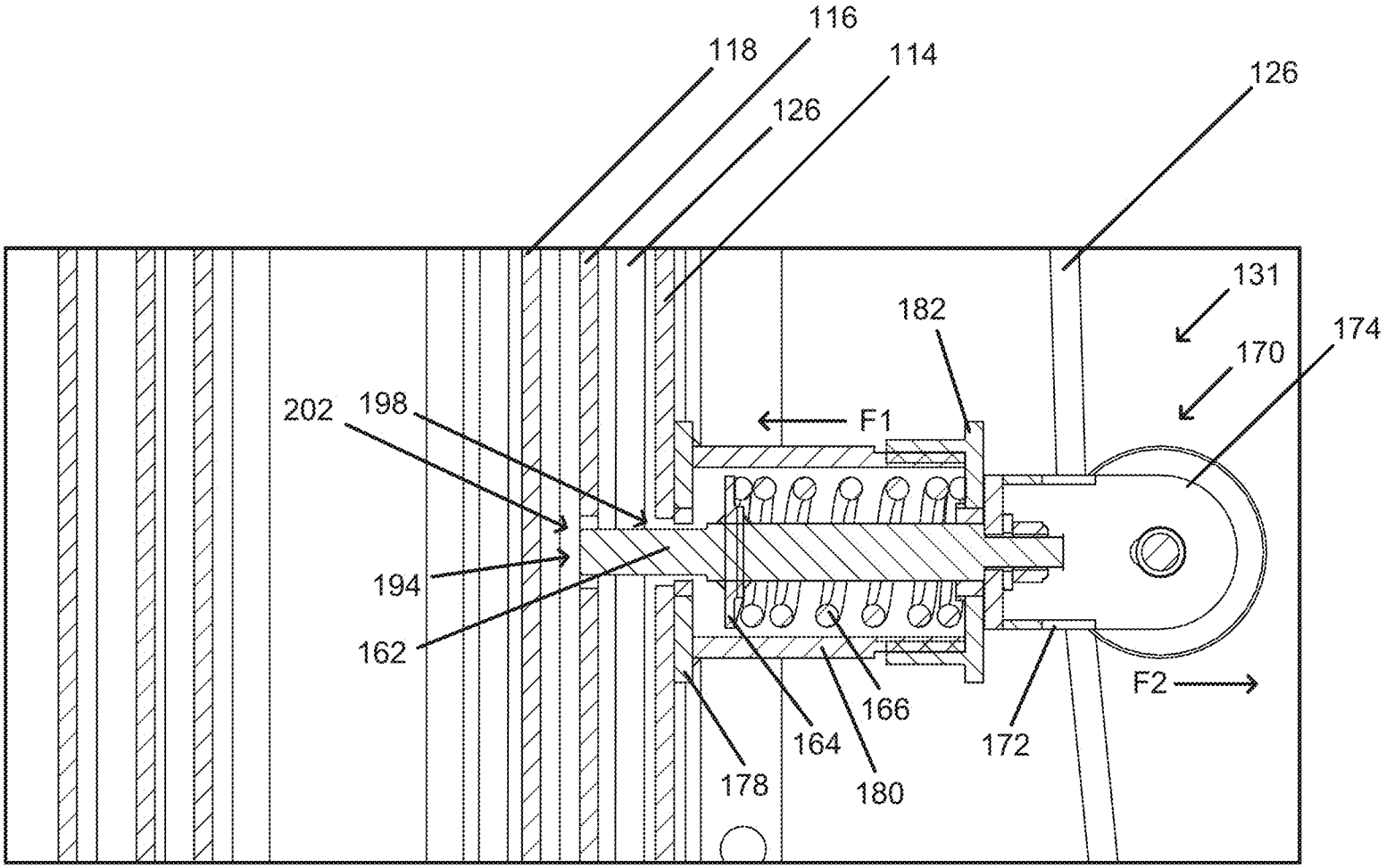
FIG. 14 is a zoomed in cross-sectional view of the stop of FIG. 9 arranged on the telescoping mast of FIG. 3 in the engaged position.

FIG. 14 is a zoomed in cross-sectional view of the stop 131, in the engaged position, mounted in place on the telescoping mast 104, taken along line 1 of FIG. 3.

Figure 15:
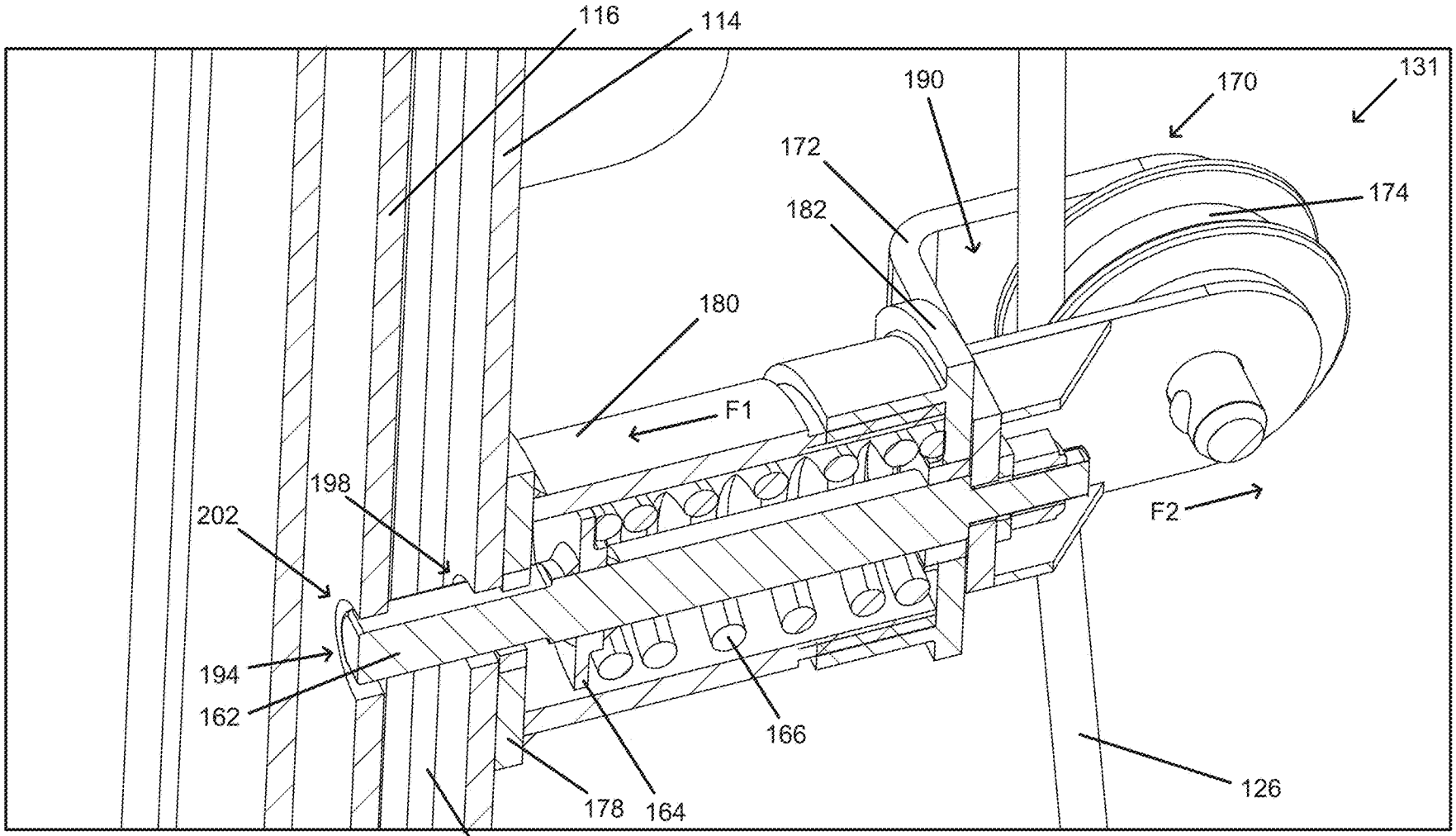
FIG. 15 is a zoomed in perspective cross-sectional view of the stop of FIG. 9 arranged on the telescoping mast of FIG. 3 in the engaged position.

FIG. 15 is a zoomed in perspective view of the cross-sectional view of FIG. 14. As shown in FIG. 14 and FIG. 15, the stop 131 is mounted to the first pillar 114 of the telescoping mast 104. In some examples, the fixed plate 178 of the stop 131 is attached to the first pillar 114. The fixed plate 178 can be attached to the first pillar 114 by various means, such as welding, or through the use of fasteners, such as bolts or screws. In some examples, the stop 131 does not include a separate fixed plate 178 such that a first end of the tube 180 is mounted directly to the sidewall of the first pillar 114. In such examples, the sidewall of the first pillar 114 comprises the fixed plate 178. In some examples, the first pillar 114 includes a hole 198 formed in the sidewall, and the fixed plate 178 is secured onto the first pillar 114 at a location over the hole 198. In some examples, the fixed plate 178 is arranged such that the central hole 184 is arranged coaxially with the hole 198 on the first pillar 114. As shown in FIGS. 14-15, in some examples, the pin 162 is movable through the hole 198 of the first pillar 114 when the stop 131 is secured thereto. In some examples, the pin 162 extends through the hole 198 while the stop 131 is in the engaged position.

In some examples, the second pillar 116 includes an engagement feature. In some examples, the engagement feature is a hole 202 formed in the sidewall of the second pillar 116. In some examples, the hole 202 is arranged coaxially with the hole 198. In some examples, the pin 162 extends through both the hole 198 of the first pillar 114 and the hole 202 of the second pillar 116 when the stop 131 is in the engaged position. In some examples, When the stop 131 is in the engaged position and the pin 162 extends through the hole 198 of the first pillar 114 and the hole 202 of the second pillar 116, the second pillar 116 is movably fixed with respect to the first pillar 114.

In some examples, the third pillar 118 also includes a hole formed in the sidewall of the third pillar 118. In some examples, the fourth pillar 120 also includes a hole formed in the sidewall of the fourth pillar. In some examples, the hole of the fourth pillar 120 is arranged coaxially with the hole of the third pillar 118. In some examples, the hole of the third pillar 118 is arranged coaxially with the hole 202 of the second pillar 116 and the hole 198 of the first pillar 114. In some examples, when the stop 131 is in the engaged position the pin 162 extends through the hole 198 of the first pillar 114, the hole 202 of the second pillar 116, and the hole of the third pillar 118. In some examples, the pin 162 also extends through the hole of the fourth pillar 120. In such examples, the third pillar 118 is movably fixed with respect to the second pillar 116 and the first pillar 114 and/or the fourth pillar 120 is movably fixed with respect to the third pillar 118, the second pillar 116, and the first pillar 114.

In some examples, when mounted in place on the telescoping mast 104, the first cable 126 extends through the pulley assembly 170 of the stop 131. Specifically, the first cable extends through the pulley space 190 in between the pulley 174 and the bracket 172. In some examples, the first cable 126 exerts a force F2 on the pulley 174. However, as noted previously, when in the engaged position, as shown in FIG. 14 and FIG. 15, the force F2 from the first cable 126 does not exceed the force F1 of the spring. In some examples, the force F2 from the first cable 126 is less than the force F1 of the spring when the tension in the first cable 126 is below a particular threshold or when the first cable 126 is broken.

In some examples, as shown in FIG. 15, the portion of the first cable 126 extending through the pulley assembly 170 and the portion of the first cable 126 extending between the first pillar 114 and the second pillar 116 are approximately arranged in a first plane. In some examples, the pulley 174 is also approximately arranged in the first plane. In some examples, the pin 162 is arranged in a second plane that is parallel with the first plane. In some examples, the first plane and the second plane are spaced apart from each other by an offset distance. In some examples, the offset distance prevents the pin 162 from contacting the portion of the first cable 126 arranged between the first pillar 114 and the second pillar 116 when the stop 131 is in the extended position. In some examples, offset distance is provided by the shape of the bracket 172, which holds the pulley 174 at the offset distance from the pin 162.

Figure 16:
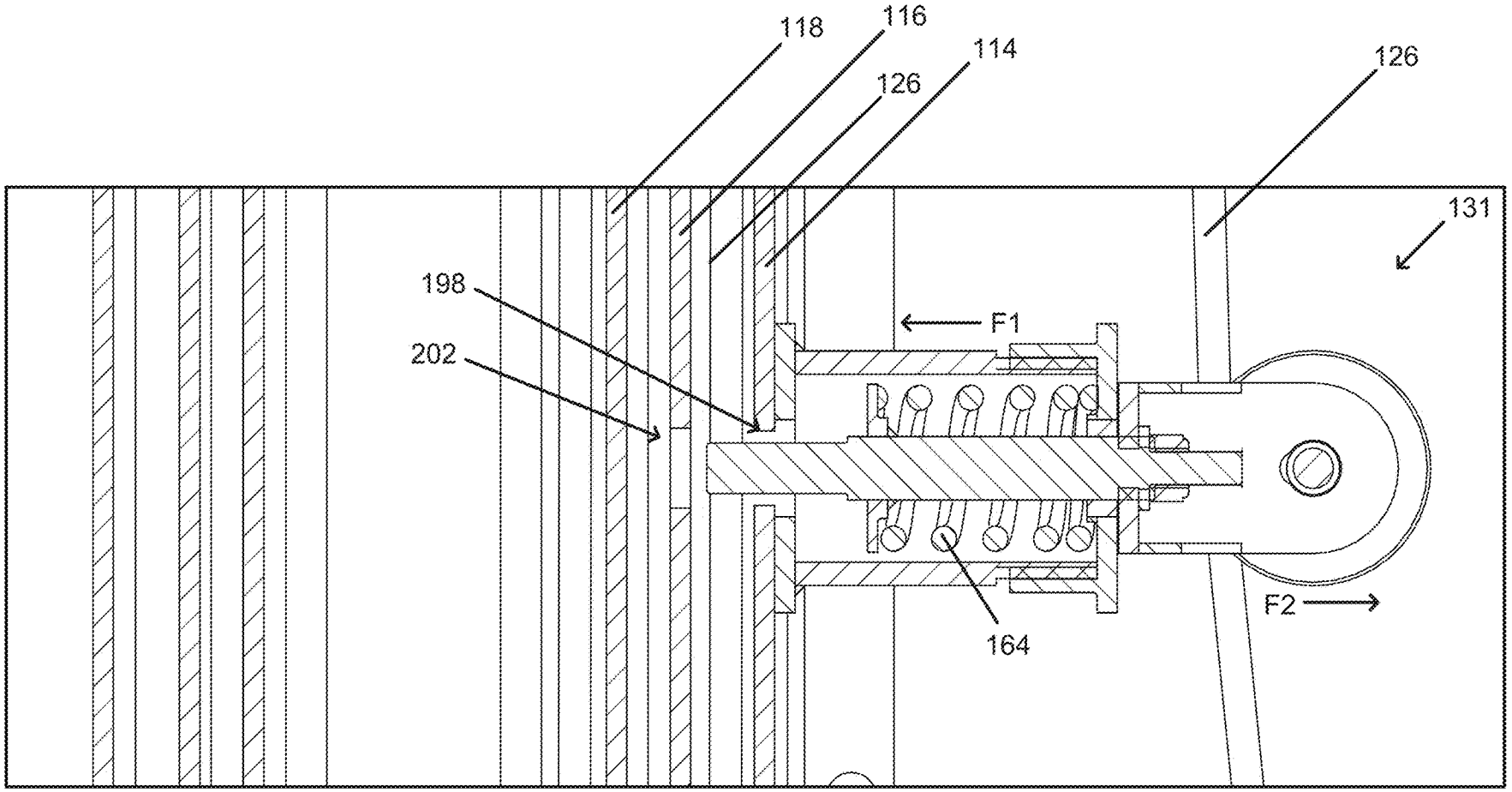
FIG. 16 is a zoomed in cross-sectional view of the stop of FIG. 9 arranged on the telescoping mast of FIG. 3 in the disengaged position.

FIG. 16 is a zoomed in cross-sectional view of the stop 131, in the disengaged position, mounted in place on the telescoping mast 104, taken along line 1 of FIG. 3.

Figure 17:
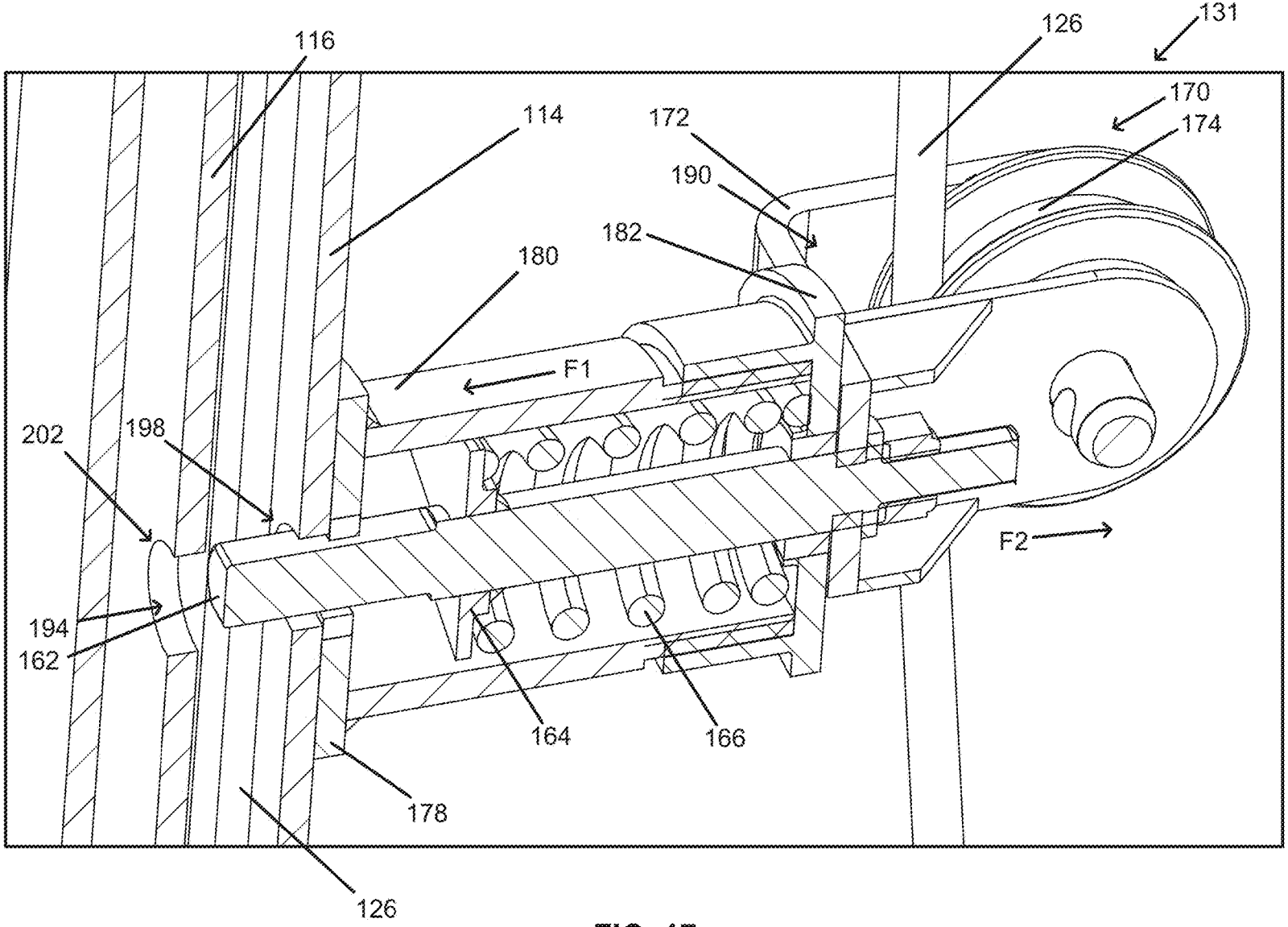
FIG. 17 is a zoomed in perspective cross-sectional view of a cross section of the stop of FIG. 9 arranged on the telescoping mast of FIG. 3 in the disengaged position.

FIG. 17 is a zoomed in perspective view of the cross-sectional view of FIG. 16. As shown in the examples of FIG. 16 and FIG. 17, when the stop 131 is in the disengaged position, the pin 162 does not extend through the hole 202 of the second pillar 116. In some examples, when in the disengaged position, the pin 162 extends through the hole 202 of the second pillar 116. In some examples, when in the disengaged position, the first end 194 of the pin 162 is arranged in the space between the first pillar 114 and the second pillar 116. In some examples, when in the disengaged position, the second pillar 116 is movable with respect to the first pillar 114.

In some examples, the stop 131 is moved into the disengaged position by the first cable 126. In some examples, as the tension of the first cable 126 is increased, pulley assembly 170 is moved away from the first pillar 114. As the pulley assembly 170 is moved away from the first pillar, the first end 194 of the pin 162 is moved out from its position within the hole 202 of the second pillar 116 into the disengaged position. In some examples, the increased tension in the first cable 126 generates a force F2 that causes the pulley assembly 170 to move away from the first pillar 114. In some examples, when the force F2 from the tension in the first cable 126 exceeds the force F1 from the spring 166, the stop 131 is placed into the disengaged position. In some examples, the tension in the first cable 126 is increased as the first cable 126 is wound onto the winch as a user attempts to raise the telescoping mast 104 into the extended position.

In some examples, as the tension in the first cable 126 is released, the stop 131 moves back into the engaged position of FIG. 14 and FIG. 15. In some examples, the tension in the first cable 126 is released if the first cable 126 breaks, or after the telescoping mast 104 has been lowered by a user into the retracted position.

Figure 18:
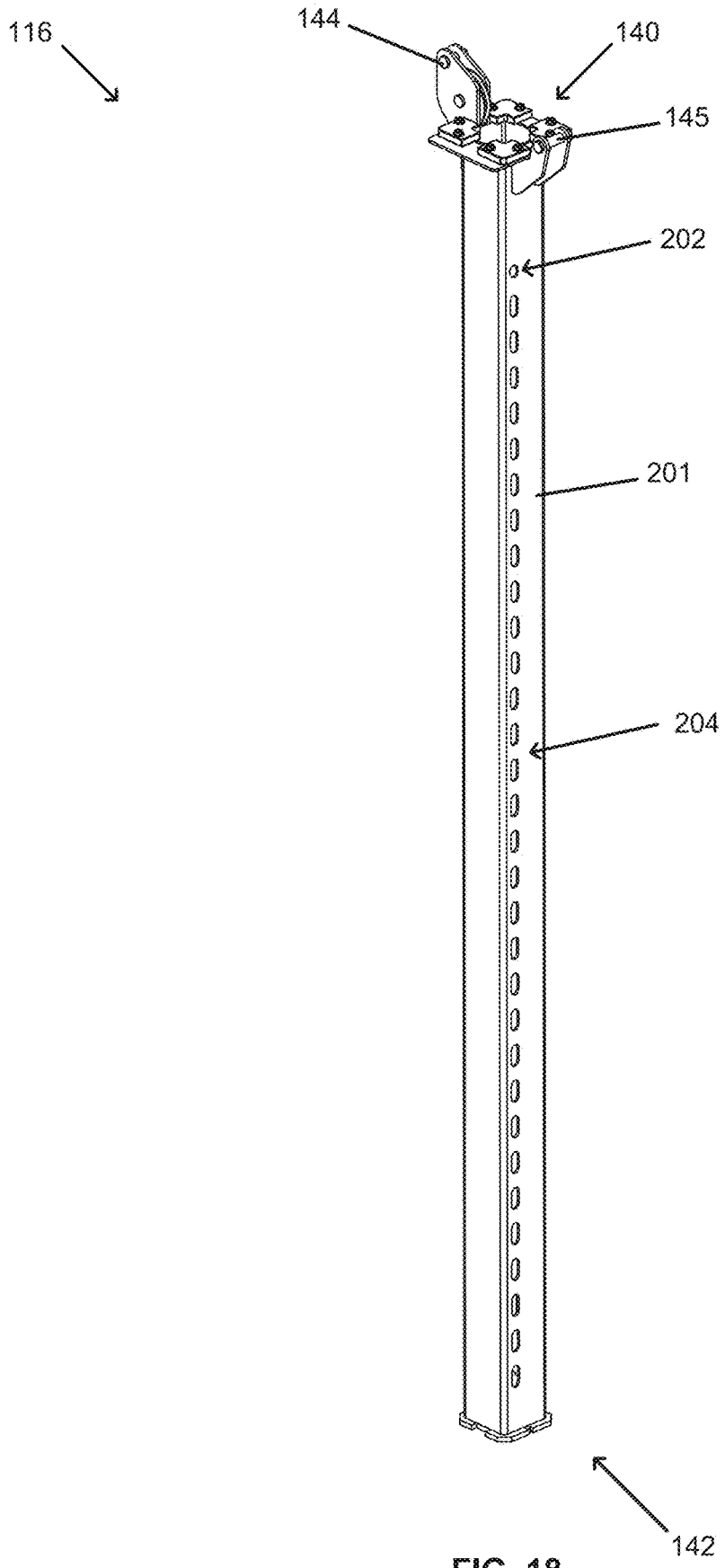
FIG. 18 is a perspective view of an example second pillar.

FIG. 18 is a side view of an example second pillar 116. As previously noted, in some examples, the second pillar 116 includes a top end 140 a bottom end 142, the second pulley 144, and the third cable attachment point 145. In some examples, the second pillar 116 includes a sidewall 201. Furthermore, as previously noted, the second pillar 116 further includes the hole 202. In some examples, the hole 202 is a first hole 202. In some examples, the second pillar 116 includes an additional array of holes 204. In some examples, the first hole 202 and the additional array of holes 204 are both arranged on the sidewall 201. The first hole 202 is arranged toward the top end 140 of the second pillar 116, and the additional array of holes 204 is arranged toward the bottom end 142 of the second pillar 116. In some examples, the additional array of holes 204 extends along a length of the second pillar 116 between the top end 140 and the bottom end 142. In some examples, the additional array of holes extends along substantially the entire length of the second pillar 116 from the top end 140 to the bottom end 142, such as, for example, from the first hole 202 to the bottom end 142.

In some examples, the first hole 202 is a round hole while the additional array of holes 204 includes a plurality of holes, each of which has an ellipse shape with a major axis extending between the top end 140 and the bottom end 142 of the second pillar 116.

Figure 19:
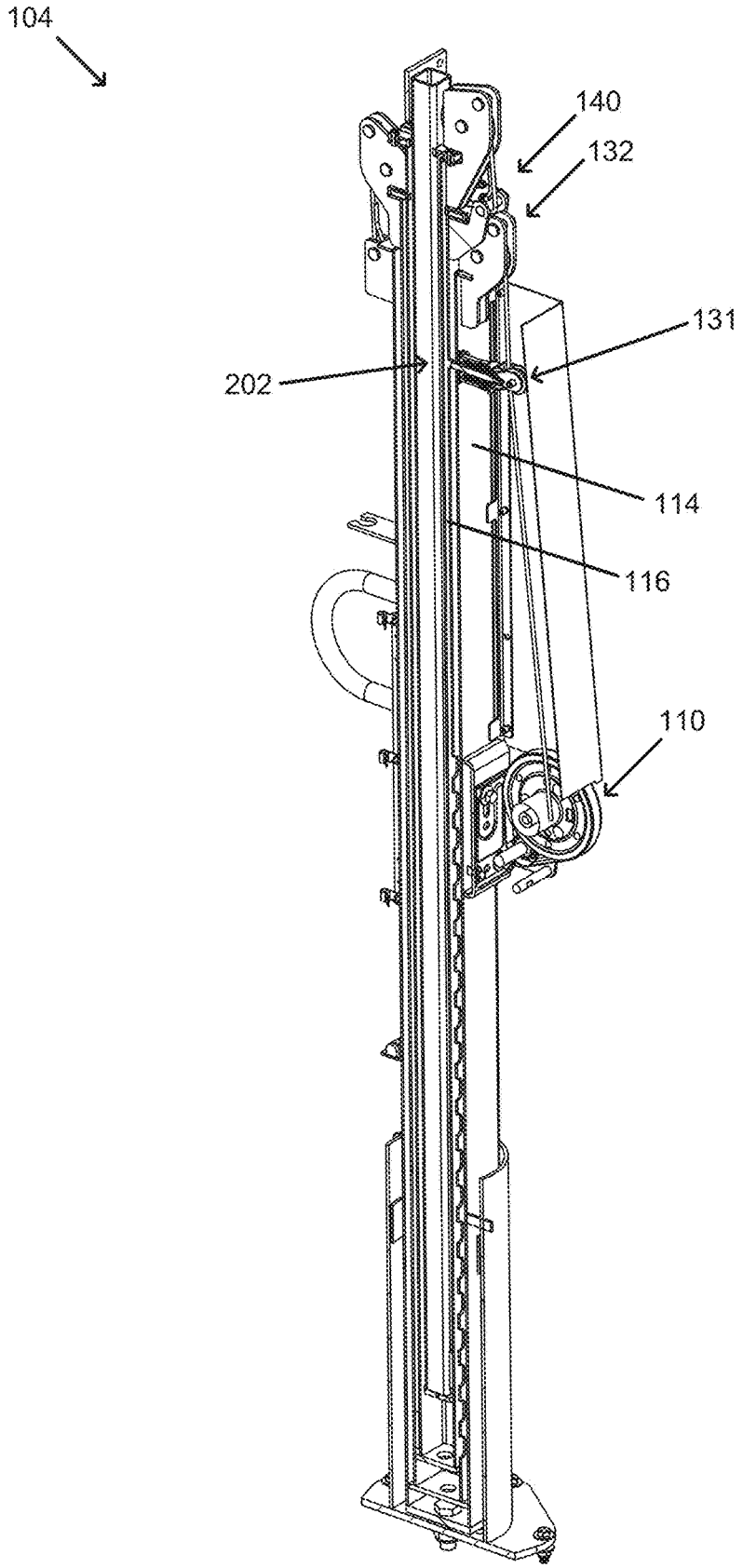
FIG. 19 is a perspective cross-sectional view of the telescoping mast of FIG. 3 in the retracted position.

FIG. 19 is a cross-sectional perspective view of the telescoping mast 104 in the retracted position, taken along line 1 of FIG. 3 In the example of FIG. 19, the stop 131 is shown in the engaged position with the pin 162 extending into the first hole 202 of the second pillar 116 (as illustrated in detail in FIG. 14 and FIG. 15. As shown in FIG. 19, the telescoping mast 104 is shown in the retracted position. As previously noted, when the telescoping mast 104 is in the retracted position, the top end 140 of the second pillar 116 is arranged adjacent the top end 132 of the first pillar 114. As shown in the example of FIG. 19, the stop 131 is also arranged adjacent the top end 132 of the first pillar 114. Thus, when in the retracted position, the pin 162 of the stop 131 extends through the first hole 202, which, due to its position at the top end 140 of the second pillar 116, is also arranged adjacent the top end 132 of the first pillar 114. When the stop 131 is engaged with the first hole 202 of the second pillar 116, the second pillar 116 is unable to move, as it is fixed in place in the retracted position.

Figure 20:
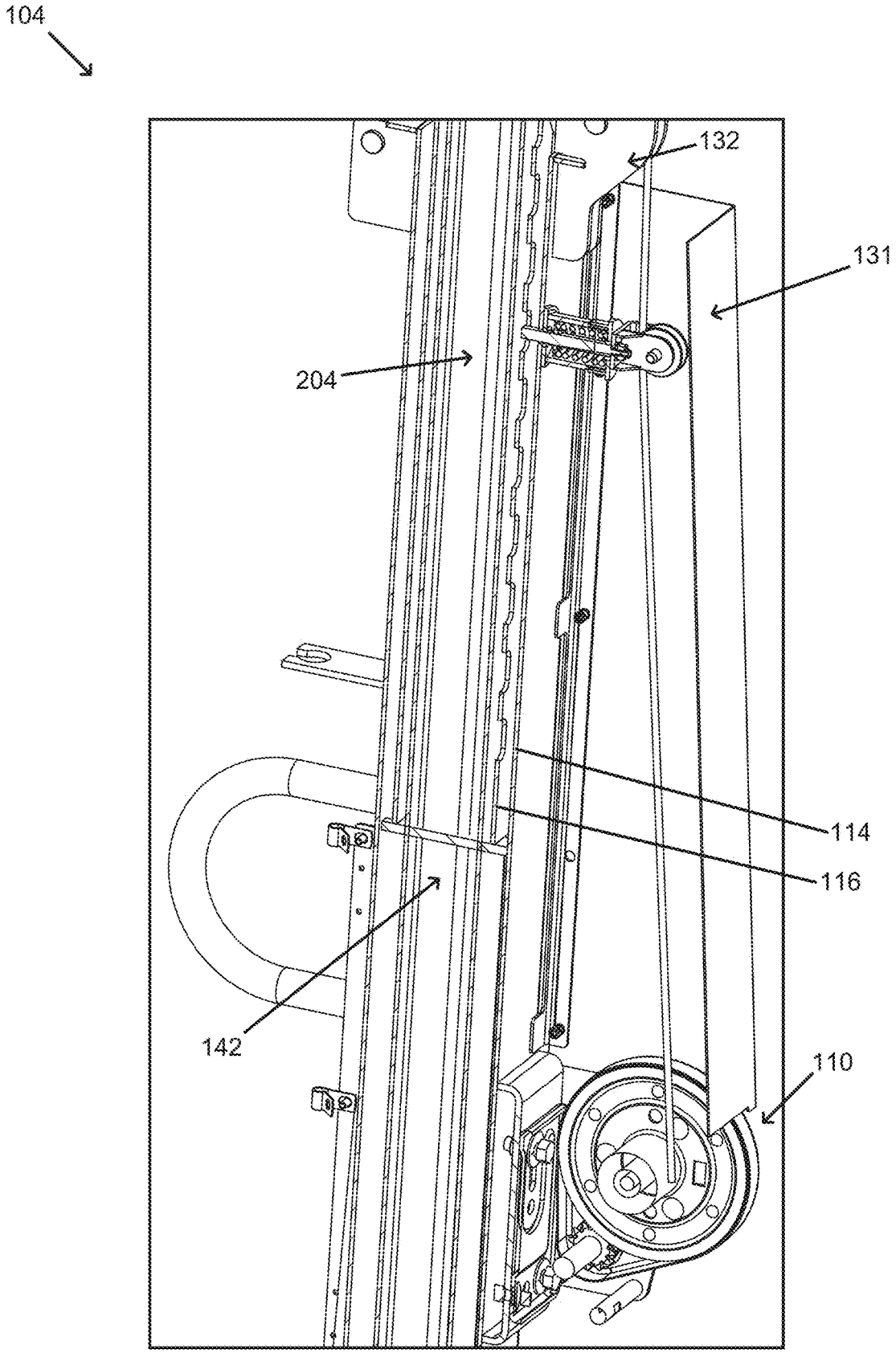
FIG. 20 is a perspective cross-sectional view of the telescoping mast of FIG. 3 in the extended position.

FIG. 20 is a cross-sectional perspective view of a portion the telescoping mast 104 in the extended position, with the stop 131 shown in the disengaged position, taken along line 1 of FIG. 3. As shown in FIG. 20, as the second pillar 116 is raise into the extended position (and the third and fourth pillars are raised into the extended positions), the bottom end 142 of the second pillar 116 is brought closer to the top end 132 of the first pillar 114, which brings the array of holes 204 on the second pillar 116 adjacent to the stop 131. Due to the tension in the first cable 126 that is used to lift the second pillar 116 into the extended position, in the example of FIG. 20, the stop 131 moved into the disengaged position.

As previously noted, the stop 131 is shown arranged in a location near the top end 132 of the first pillar 114 between the first pulley 138 and the winch 110. In some examples, the stop 131 is arranged closer to the first pulley 138 than the winch 110. In some examples, it is advantageous to arrange the stop 131 closer to the first pulley 138 than the winch 110 because as cable is spooled onto the winch, the first cable 126 may vary in position on the winch. This causes movement in the length of first cable 126 between the winch 110 and the first pulley 138. However, generally, the position of the first cable 126 proximate to the first pulley 138 varies less than the position of the first cable 126 proximate to the winch 110. Therefore, by arranging the stop 131 towards the top end 132 of the first pillar 114, the stop 131 can contact the first cable 126 at a portion of the first cable 126 that does not exhibit large amounts of lateral movement.

Figure 21:
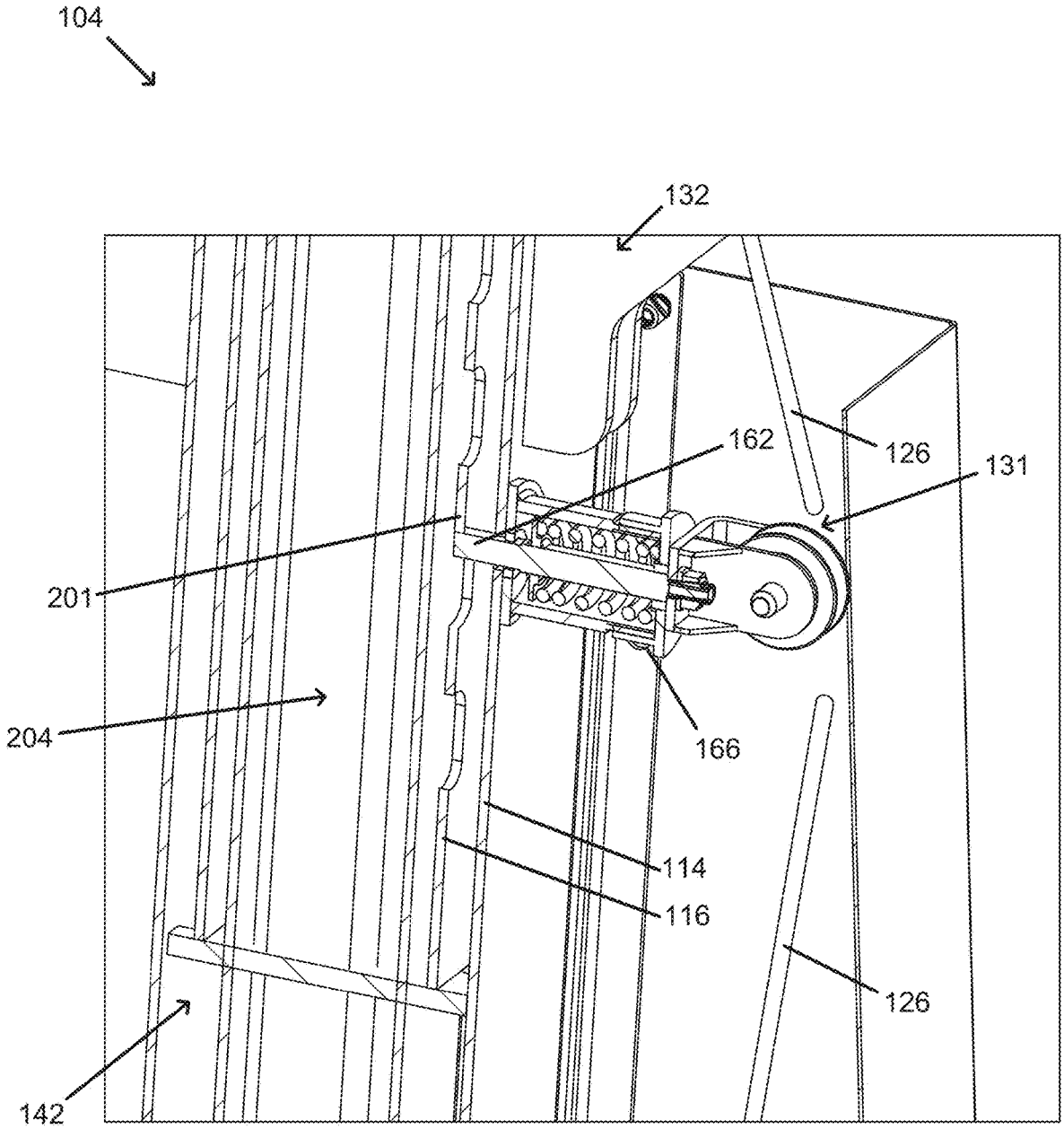
FIG. 21 is a zoomed in perspective cross-sectional view of the stop of FIG. 9 in the engaged position on the telescoping mast of FIG. 3 in the extended position.

FIG. 21 is a cross-sectional perspective view of a portion of the telescoping mast 104 in the extended position, with the stop 131 shown in the engaged position, taken along line 1 of FIG. 3. As shown in FIG. 21, the telescoping mast 104 is shown with a broken first cable 126. In some examples, the first cable 126 may break while the telescoping mast 104 is in the extended position. The stop 131 may function to catch the second pillar 116 before it falls into the retracted position. In some examples, by catching the second pillar 116 damage can be avoided by minimizing the likelihood that objects, such as a light, mounted to the top of the telescoping mast 104 contact objects arranged near the surface upon which the telescoping mast 104 is arranged.

In some examples, as the first cable 126 breaks, the first cable 126 stops exerting a force (labeled F2 in FIG. 16 and FIG. 17) on the stop 131 to hold the stop in the disengaged position. This causes the spring 166 in the stop 131 to force the moving portion of the stop 131 into the engaged position, which causes the pin 162 to move towards the second pillar 116. In some examples, such as in the example of FIG. 21, the pin 162 may be moved towards the second pillar 116 as one of the holes from the array of holes 204 is arranged in the pathway of the pin 162. In such examples, the pin 162 extends into the hole 204 and restricts any further motion of the second pillar 116.

In some examples, as the first cable 126 breaks, the pin 162 may be moved towards the second pillar 116 as a portion of the sidewall 201 between the array of holes 204 is arranged in the pathway of the pin 162. In such examples, the pin 162 contacts the portion of the sidewall and is pushed into the sidewall 201 by the spring 166 in the stop 131. In this case, the motion of the second pillar is not yet restricted, and the second pillar 116 will most likely continue to fall downward into the retracted position due to the force of gravity. However, as the second pillar 116 moves into the retracted position, one of the holes 204 of the array of holes 204 will move into the pathway of the pin 162. Once the hole 204 moves into the pathway of the pin 162, the spring 166 in the stop 131 will continue to push the pin 162 into the second pillar 116 such that the pin 162 extends into the hole 204. Once the pin extends into the hole 204, the pin 162 restricts any further motion of the second pillar.

In some examples, once the motion of the second pillar 116 is restricted by the pin 162 to prevent the second pillar 116 from falling into the retracted position, the motion of the third pillar 118 and the fourth pillar 120 is also restricted. As previously described with respect to FIG. 8, The motion of the third pillar 118 is dependent on the motion of the second pillar 116 by the second cable 128 and the motion of the fourth pillar 120 is dependent on the motion of the third pillar 118 by the third cable 130. As the motion of the second pillar 116 is restricted, the motion of the third pillar 118 is restricted by the second cable 128. Likewise, as the motion of the third pillar 118 is restricted, the motion of the fourth pillar 120 is restricted by the third cable 130. Thus, the movement of the stop 131 from the disengaged to the engaged position can function to restrict the motion of the second pillar 116, the third pillar 118, and the fourth pillar 120 from the extended to the retracted position. This allows the rapid movement of the telescoping mast 104 from the extended position to the retracted position to be avoided in the event of the first cable 126 breaking.

The various embodiments described above are provided by way of illustration only and should not be construed to limit the claims attached hereto. Those skilled in the art will readily recognize various modifications and changes that may be made without following the example embodiments and applications illustrated and described herein, and without departing from the full scope of the following claims.

What is claimed is:

1. A stop device for a telescoping mast assembly, the stop device comprising:

a fixed portion including a tube with an opening, the tube being configured to be mounted on a pillar of the telescoping mast assembly; and a movable portion including a pulley assembly and a pin, the pin extending through the opening;

the movable portion being movable between an engaged position in which the pin extends a first distance out of the opening and a disengaged position in which the pin extends a second distance out of the opening.

2. The stop device of claim 1, wherein the first distance is greater than the second distance.

3. The stop device of claim 2, further comprising a spring that biases the movable portion into the engaged position.

4. The stop device of claim 3, wherein the spring is arranged within the tube.

5. The stop device of claim 4, wherein a portion of the pin is arranged within the tube.

6. The stop device of claim 5, wherein the pulley assembly is affixed to the pin.

7. The stop device of claim 6, wherein movement of the pulley assembly away from the tube causes the movable portion to move into the disengaged position.

8. The stop device of claim 7, wherein the pin comprises a movable plate.

9. The stop device of claim 8, wherein the movable plate is arranged within the tube.

10. The stop device of claim 9, wherein the movable plate is arranged between the spring and the opening of the tube.

11. A telescoping mast assembly comprising:

an outer pillar with a hollow interior, the outer pillar having at least one opening in a sidewall thereof;

an inner pillar slidable within the hollow interior of the outer pillar, the inner pillar including at least one engagement feature in a sidewall thereof; and a stop device mounted on the sidewall of the outer pillar, the stop device including:

a fixed portion including a tube with a tube opening, the tube being configured to be mounted on the outer pillar of the telescoping mast assembly; and a movable portion comprising:

a pin extending through at least one opening of the outer pillar and the tube opening; and a pulley assembly affixed to the pin;

the movable portion being movable between:

an engaged position in which the pin extends a first pin protrusion distance out of the tube opening so that the pin is engaged with the engagement feature and the pulley assembly is arranged at a first distance from the outer pillar, and a disengaged position in which the pin extends a second pin protrusion distance out of the tube opening so that the pin is not engaged with the engagement feature and the pulley assembly is arranged at a second distance from the outer pillar, wherein the first distance is less than the second distance.

12. The assembly of claim 11, wherein the engagement feature is a hole, and wherein the pin extends into the engagement feature.

13. The assembly of claim 11, wherein the stop device further comprises a spring that biases the movable portion into the engaged position.

14. The assembly of claim 13, further comprising a cable used to hoist the inner pillar into an extended position, wherein the cable is configured to contact the stop device as the inner pillar is hoisted.

15. The assembly of claim 14, wherein the cable exerts a force on the pulley assembly as the inner pillar is hoisted into the extended position.

16. The assembly of claim 15, wherein the force exerted by the cable on the pulley assembly causes the movable portion of the stop device to move into the disengaged position.

17. The assembly of claim 16, further comprising a third pillar and a second cable.

18. The assembly of claim 17, wherein the third pillar is arranged within the inner pillar, and wherein the second cable extends between the outer pillar and the third pillar, and wherein the movement of the third pillar is dependent on the movement of the inner pillar by the second cable.

19. The assembly of claim 11, wherein the inner pillar includes a plurality of engagement features.

20. The assembly of claim 11, wherein the pulley assembly is affixed to the pin by a bracket.

* * * * *